US011920834B2

(12) United States Patent
Shey et al.

(10) Patent No.: US 11,920,834 B2
(45) **Date of Patent: *Mar. 5, 2024**

(54) VAPOR INJECTION HEAT PUMP

(71) Applicant: Ford Global Technologies, LLC, Dearborn, MI (US)

(72) Inventors: Rachael E. Shey, Clawson, MI (US); Jeffrey Paul Brown, Farmington Hills, MI (US); Leyuan Yu, Cypress, TX (US); James C. Rollinson, Superior Township, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/740,580

(22) Filed: May 10, 2022

(65) Prior Publication Data

US 2023/0366595 A1 Nov. 16, 2023

(51) Int. Cl.
*F25B 40/00* (2006.01)
*F25B 41/20* (2021.01)

(52) U.S. Cl.
CPC ..... *F25B 40/00* (2013.01); *F25B 41/20* (2021.01)

(58) Field of Classification Search
CPC ..... F25B 40/02; F25B 40/00; F25B 41/20; F25B 41/24; F25B 41/40; F25B 41/42; F25B 47/02; F25B 2400/13; B60H 1/00278; B60H 1/00271; B60H 1/00392; B60H 1/3207; B60H 1/321; B60H 1/32281

See application file for complete search history.

(56) References Cited

U.S. PATENT DOCUMENTS 10,457,111 B2 10/2019 Gebbie et al.
2021/0061067 A1* 3/2021 Kim ..... B60H 1/00921

FOREIGN PATENT DOCUMENTS

EP 1072453 A2 * 1/2001 ..... B60H 1/00342
JP 2011208841 A * 10/2011 ..... B60H 1/00899
WO WO-2019244764 A1 * 12/2019 ..... F25B 1/10
WO WO-2020213537 A1 * 10/2020 ..... F25B 41/20

OTHER PUBLICATIONS

WO-2019244764-A1 English Translation (Year: 2019).*
JP-2011208841-A English Translation (Year: 2011).*
WO-2020213537-A1 English Translation (Year: 2020).*

* cited by examiner

*Primary Examiner* — Steve S Tanenbaum
*Assistant Examiner* — Devon Moore
(74) *Attorney, Agent, or Firm* — Vichit Chea; Price Heneveld LLP

(57) ABSTRACT

A heat pump includes a refrigerant loop. The refrigerant loop includes a compressor, a first region of a first heat exchanger, a first branching point, a first shutoff valve, a second shutoff valve, and a second heat exchanger. The compressor includes a low-pressure inlet, a mid-pressure inlet, and an outlet. The first heat exchanger is positioned immediately downstream of the outlet of the compressor. The first branching point is positioned immediately downstream of the first region of the first heat exchanger. The refrigerant loop splits into a first path and a second path at the first branching point. The first shutoff valve is positioned along the first path and immediately downstream of the first branching point. The second shutoff valve is positioned along the second path and immediately downstream of the first branching point. The second heat exchanger is downstream of the first heat exchanger.

16 Claims, 18 Drawing Sheets

VAPOR INJECTION HEAT PUMP

FIELD OF THE DISCLOSURE

The present disclosure generally relates to heat pumps. More specifically, the present disclosure generally relates to vapor injection heat pumps.

BACKGROUND OF THE INVENTION

Heat pumps have been employed in vehicles. A refrigerant loop can be included in such heat pumps.

SUMMARY OF THE INVENTION

According to a first aspect of the present invention, a heat pump includes a refrigerant loop. The refrigerant loop includes a compressor, a first region of a first heat exchanger, a first branching point, a first shutoff valve, a second shutoff valve, and a second heat exchanger. The compressor includes a low-pressure inlet, a mid-pressure inlet, and an outlet. The first heat exchanger is positioned immediately downstream of the outlet of the compressor. The first branching point is positioned immediately downstream of the first region of the first heat exchanger. The refrigerant loop splits into a first path and a second path at the first branching point. The first shutoff valve is positioned along the first path and immediately downstream of the first branching point. The second shutoff valve is positioned along the second path and immediately downstream of the first branching point. The second heat exchanger is positioned downstream of the first heat exchanger.

Embodiments of the first aspect of the invention can include any one or a combination of the following features:

- the refrigerant loop further includes a second branching point that is positioned immediately downstream of the second heat exchanger;
- the refrigerant loop further includes a third shutoff valve that is positioned immediately downstream of the second branching point;
- the refrigerant loop further includes an intersection point that is positioned immediately downstream of the third shutoff valve;
- the intersection point operates as a branching point in a first mode of operation, wherein the intersection point operates as a coupling point in a second mode of operation;
- the refrigerant loop further includes a first expansion valve that is positioned immediately downstream of the intersection point;
- the refrigerant loop further includes a third branching point that is positioned immediately downstream of the intersection point in at least one mode of operation;
- the third branching point is positioned immediately downstream of the second shutoff valve in at least a separate mode of operation;
- the intersection point is positioned immediately downstream of the third branching point in the separate mode of operation;
- the refrigerant loop further includes a vapor generator that includes a first region and a second region, wherein the first region is positioned immediately downstream of the first expansion valve, and wherein the second region is positioned immediately downstream of the third branching point;
- the vapor generator is positioned upstream of both the low-pressure inlet and the mid-pressure inlet, wherein the vapor generator delivers at least a portion of a gaseous component of a first heat exchange fluid to the mid-pressure inlet of the compressor;
- the vapor generator is positioned upstream of the second heat exchanger in a first mode of operation, wherein the vapor generator is positioned downstream of the second heat exchanger in a second mode of operation;
- the refrigerant loop further includes a fourth branching point that is positioned immediately downstream of the second region of the vapor generator;
- the refrigerant loop further includes a fourth shutoff valve that is positioned immediately downstream of the fourth branching point;
- the refrigerant loop further includes a second expansion valve that is positioned immediately downstream of the fourth branching point, wherein the second expansion valve is upstream of the second heat exchanger; and
- the refrigerant loop further includes a fifth branching point that is positioned immediately downstream of the second branching point, a fifth shutoff valve that is positioned immediately downstream of the fifth branching point, and a sixth shutoff valve that is positioned immediately downstream of the fifth branching point.

According to a second aspect of the present disclosure, a heat pump includes a refrigerant loop. The refrigerant loop includes a compressor, a first region of a first heat exchanger, a first branching point, a first shutoff valve, a second shutoff valve, a second heat exchanger, a second branching point, a third shutoff valve, an intersection point, a first expansion valve, a third branching point, and a vapor generator. The compressor includes a low-pressure inlet, a mid-pressure inlet, and an outlet. The first heat exchanger is positioned immediately downstream of the outlet of the compressor. The first branching point is positioned immediately downstream of the first region of the first heat exchanger. The refrigerant loop splits into a first path and a second path at the first branching point. The first shutoff valve is positioned along the first path and immediately downstream of the first branching point. The second shutoff valve is positioned along the second path and immediately downstream of the first branching point. The second heat exchanger is positioned downstream of the first heat exchanger. The second branching point is positioned immediately downstream of the second heat exchanger. The third shutoff valve is positioned immediately downstream of the second branching point. The intersection point is positioned immediately downstream of the third shutoff valve. The first expansion valve is positioned immediately downstream of the intersection point. The third branching point is positioned immediately downstream of the intersection point in at least one mode of operation. The vapor generator includes a first region and a second region. The first region of the vapor generator is positioned immediately downstream of the first expansion valve. The second region of the vapor generator is positioned immediately downstream of the third branching point.

Embodiments of the second aspect of the present disclosure can include any one or a combination of the following features:

- the intersection point operates as a branching point in a first mode of operation, wherein the intersection point operates as a coupling point in a second mode of operation;
- the third branching point is positioned immediately downstream of the second shutoff valve in at least a separate mode of operation, wherein the intersection point is positioned immediately downstream of the third branching point in the separate mode of operation; and the vapor generator is positioned upstream of the second heat exchanger in a first mode of operation, wherein the vapor generator is positioned downstream of the second heat exchanger in a second mode of operation.

These and other aspects, objects, and features of the present disclosure will be understood and appreciated by those skilled in the art upon studying the following specification, claims, and appended drawings.

DETAILED DESCRIPTION OF THE PREFERRED EMBODIMENTS

Figure 1:
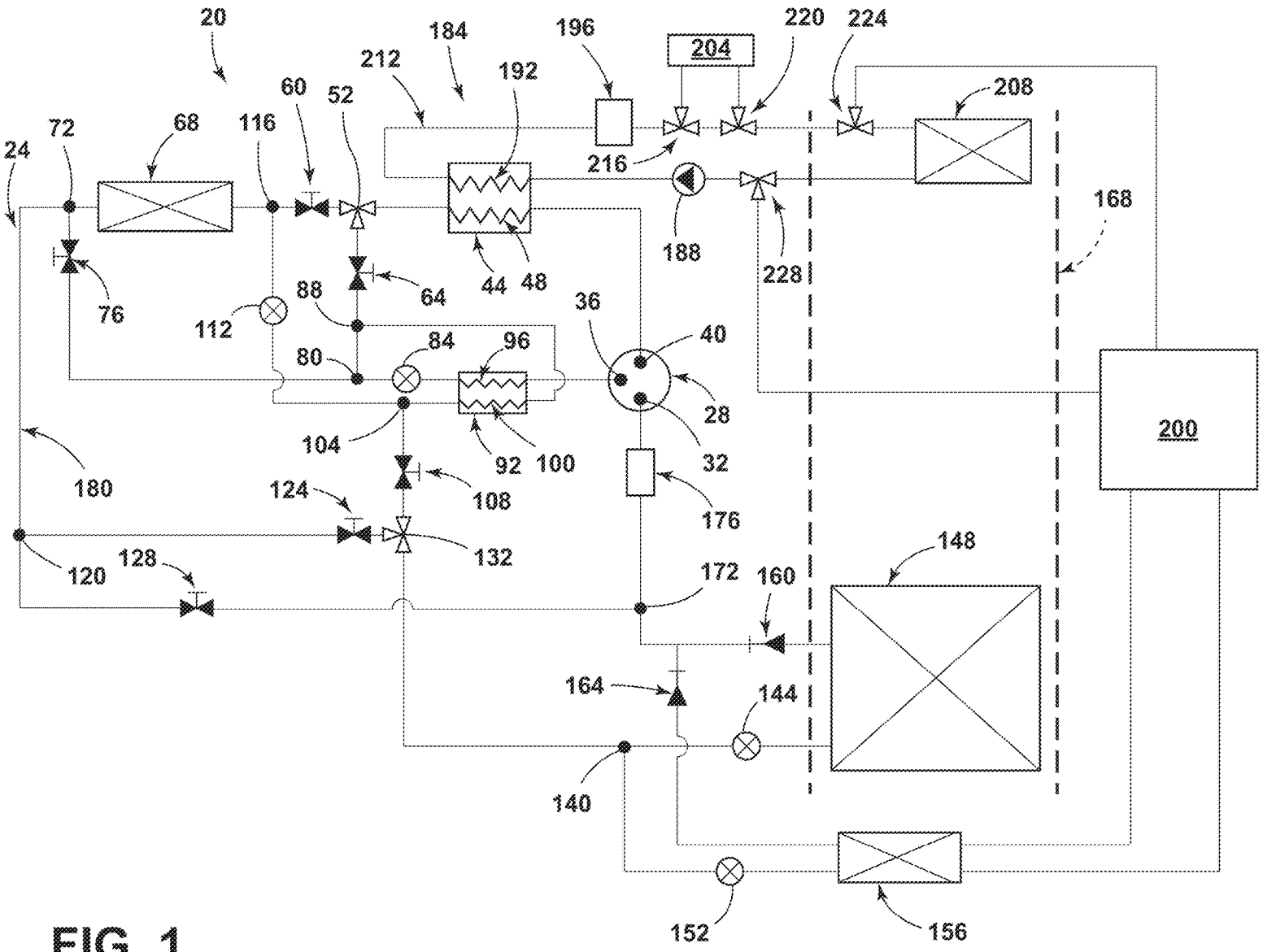
FIG. 1 is a schematic representation of a heat pump arrangement, illustrating a refrigerant loop and a coolant loop, according to one example.

For purposes of description herein, the terms "upper," "lower," "right," "left," "rear," "front," "vertical," "horizontal," and derivatives thereof shall relate to the concepts as oriented in FIG. 1. However, it is to be understood that the concepts may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The present illustrated embodiments reside primarily in combinations of method steps and apparatus components related to a heat pump. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

As used herein, the term "and/or," when used in a list of two or more items, means that any one of the listed items can be employed by itself, or any combination of two or more of the listed items, can be employed. For example, if a composition is described as containing components A, B, and/or C, the composition can contain A alone; B alone; C alone; A and B in combination; A and C in combination; B and C in combination; or A, B, and C in combination.

In this document, relational terms, such as first and second, top and bottom, and the like, are used solely to distinguish one entity or action from another entity or action, without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element preceded by "comprises . . . a" does not, without more constraints, preclude the existence of additional identical elements in the process, method, article, or apparatus that comprises the element.

As used herein, the term "about" means that amounts, sizes, formulations, parameters, and other quantities and characteristics are not and need not be exact, but may be approximate and/or larger or smaller, as desired, reflecting tolerances, conversion factors, rounding off, measurement error and the like, and other factors known to those of skill in the art. When the term "about" is used in describing a value or an end-point of a range, the disclosure should be understood to include the specific value or end-point referred to. Whether or not a numerical value or end-point of a range in the specification recites "about," the numerical value or end-point of a range is intended to include two embodiments: one modified by "about," and one not modified by "about." It will be further understood that the end-points of each of the ranges are significant both in relation to the other end-point, and independently of the other end-point.

The terms "substantial," "substantially," and variations thereof as used herein are intended to note that a described feature is equal or approximately equal to a value or description. For example, a "substantially planar" surface is intended to denote a surface that is planar or approximately planar. Moreover, "substantially" is intended to denote that two values are equal or approximately equal. In some embodiments, "substantially" may denote values within about 10% of each other, such as within about 5% of each other, or within about 2% of each other.

As used herein the terms "the," "a," or "an," mean "at least one," and should not be limited to "only one" unless explicitly indicated to the contrary. Thus, for example, reference to "a component" includes embodiments having two or more such components unless the context clearly indicates otherwise.

Referring to FIGS. 1-18, reference numeral 20 generally designates a heat pump. The heat pump 20 includes a refrigerant loop 24. In various examples, the heat pump 20 may be employed in a vehicle. In some examples, the vehicle may be a motor vehicle. The refrigerant loop 24 includes a compressor 28. The compressor 28 includes a low-pressure inlet 32, a mid-pressure inlet 36, and an outlet 40. A first heat exchanger 44 is positioned immediately downstream of the outlet 40 of the compressor 28. The refrigerant loop 24 includes a first region 48 of the first heat exchanger 44. A first branching point 52 is positioned immediately downstream of the first region 48 of the first heat exchanger 44. The refrigerant loop 24 splits into a first path and a second path at the first branching point 52. A first shutoff valve 60 may be positioned along the first path and immediately downstream of the first branching point 52. A second shutoff valve 64 may be positioned along the second path and immediately downstream of the first branching point 52.

Referring again to FIGS. 1-18, in some examples, the first branching point 52 may be a passive three-way junction where flow through the first branching point 52 is at least partially controlled by the first and second shutoff valves 60, 64. In various examples, the first branching point 52 may be provided with an actuatable three-way valve that actively controls flow through the first branching point 52. In such an example where the first branching point 52 is provided with a three-way valve, the first and second shutoff valves 60, 64 may be omitted. For the sake of brevity, the first branching point 52 will be discussed herein as though the first branching point 52 is a passive three-way junction where the first and second shutoff valves 60, 64 aid in controlling flow through the first branching point 52. However, in examples where the first branching point 52 is provided with a three-way valve, one of skill in the art will recognize how the three-way valve would be positioned for a given mode of operation in light of the discussion provided herein. A second heat exchanger 68 is positioned downstream of the first heat exchanger 44. A second branching point 72 is positioned immediately downstream of the second heat exchanger 68.

Referring yet again to FIGS. 1-18, as with the first branching point 52, at the second branching point 72, the refrigerant loop 24 splits into two paths. A third shutoff valve 76 is positioned immediately downstream of the second branching point 72. The third shutoff valve 76 may be positioned along a first path that extends from the second branching point 72. An intersection point 80 is positioned immediately downstream of the third shutoff valve 76. The intersection point 80 may operate as a branching point in a first mode of operation (e.g., see FIG. 2). The intersection point 80 may operate as a coupling point in a second mode of operation (e.g., see FIG. 5), as will be discussed further herein. A first expansion valve 84 is positioned immediately downstream of the intersection point 80. A third branching point 88 is positioned immediately downstream of the intersection point 80 in at least one mode of operation (e.g., see FIG. 2). As with the first and second branching points 52, 72, at the third branching point 88, the refrigerant loop 24 splits into two paths. A vapor generator 92 includes a first region 96 and a second region 100. The first region 96 of the vapor generator 92 is positioned immediately downstream of the first expansion valve 84. The second region 100 of the vapor generator 92 is positioned immediately downstream of the third branching point 88. The vapor generator 92 is positioned upstream of both the low-pressure inlet 32 and the mid-pressure inlet 36. The vapor generator 92 delivers at least a portion of a gaseous component of a first heat exchange fluid to the mid-pressure inlet 36 of the compressor 28, as will be discussed in further detail herein. The vapor generator 92 may be positioned upstream of the second heat exchanger 68 in a first mode of operation (e.g., see FIG. 5). The vapor generator 92 may be positioned downstream of the second heat exchanger 68 in a second mode of operation (e.g., see FIG. 2).

Referring further to FIGS. 1-18, a fourth branching point 104 is positioned immediately downstream of the second region 100 of the vapor generator 92. As with the preceding branching points, at the fourth branching point 104, the refrigerant loop 24 splits into two paths. A fourth shutoff valve 108 can be positioned along a first path that extends from the fourth branching point 104. A second expansion valve 112 can be positioned immediately downstream of the fourth branching point 104 along a second path that extends from the fourth branching point 104. The second expansion valve 112 is upstream of the second heat exchanger 68. A first coupling point 116 is positioned downstream of both the first shutoff valve 60 and the second expansion valve 112. The first coupling point 116 is immediately upstream of the second heat exchanger 68. The term "coupling point," as used herein, may refer to a convergence point where two or more paths come together, with fewer paths extending from the coupling point than the number of paths that lead to the coupling point. The term "branching point," as used herein, may refer to a divergence point where one path splits into two or more paths, with a greater number of paths extending from the branching point than the number of paths that lead to the branching point.

Referring still further to FIGS. 1-18, a fifth branching point 120 is positioned immediately downstream of the second branching point 72. The fifth branching point 120 can be positioned along a second path that extends from the second branching point 72. As with the preceding branching points, the refrigerant loop 24 splits into two paths at the fifth branching point 120. A fifth shutoff valve 124 can be positioned immediately downstream of the fifth branching point 120 along a first path that extends from the fifth shutoff valve 124. A sixth shutoff valve 128 can be positioned immediately downstream of the fifth branching point 120 along a second path that extends from the fifth shutoff valve 124. A second coupling point 132 is positioned immediately downstream of both the fourth shutoff valve 108 and the fifth shutoff valve 124.

In some examples, the second coupling point 132 may be a passive three-way junction where flow through the second coupling point 132 is at least partially controlled by the fourth and fifth shutoff valves 108, 124. In various examples, the second coupling point 132 may be provided with an actuatable three-way valve that actively controls flow through the second coupling point 132. In such an example where the second coupling point 132 is provided with a three-way valve, the fourth and fifth shutoff valves 108, 124 may be omitted. For the sake of brevity, the second coupling point 132 will be discussed herein as though the second coupling point 132 is a passive three-way junction where the fourth and fifth shutoff valves 108, 124 aid in controlling flow through the second coupling point 132. However, in examples where the second coupling point 132 is provided with a three-way valve, one of skill in the art will recognize how the three-way valve would be positioned for a given mode of operation in light of the discussion provided herein. A sixth branching point 140 is positioned immediately downstream of the second coupling point 132.

Referring yet again to FIGS. 1-18, as with the preceding branching points, the refrigerant loop 24 splits into two paths at the sixth branching point 140. A third expansion valve 144 may be positioned immediately downstream of the sixth branching point 140 along a first path that extends from the sixth branching point 140. A third heat exchanger 148 is positioned immediately downstream of the third expansion valve 144. A fourth expansion valve 152 may be positioned immediately downstream of the sixth branching point 140 along a second path that extends from the sixth branching point 140. A fourth heat exchanger 156 is positioned immediately downstream of the fourth expansion valve 152. A first check valve 160 is positioned downstream of the third heat exchanger 148. A second check valve 164 is positioned downstream of the fourth heat exchanger 156. The third heat exchanger 148 can be in fluid communication with ductwork 168 of a Heating, Ventilation, and Air Conditioning (HVAC) system. Accordingly, the third heat exchanger 148 may be employed to alter a temperature and/or a humidity of ambient air and provide temperature-controlled and/or humidity-controlled air to an environment (e.g., a cabin of a vehicle). A third coupling point 172 is positioned downstream of the first check valve 160, the second check valve 164, and the sixth shutoff valve 128. An accumulator 176 is positioned immediately upstream of the low-pressure inlet 32 of the compressor 28. The various components of the refrigerant loop 24 are coupled to one another by a refrigerant network of conduits 180. A first heat exchange fluid (e.g., a refrigerant) flows through the refrigerant network of conduits 180 and the various components of the refrigerant loop 24.

Referring again to FIGS. 1-18, the heat pump 20 includes a coolant loop 184. The coolant loop 184 includes a pump 188, a second region 192 of the first heat exchanger 44, a reservoir 196, a first heat-producing component 200, a second heat-producing component 204, and a fifth heat exchanger 208. The various components of the coolant loop 184 are fluidly coupled with one another by a coolant network of conduits 212. A second heat exchange fluid (e.g., a coolant) flows through the coolant network of conduits 212 and the components of the coolant loop 184. The fifth heat exchanger 208 can be in fluid communication with the ductwork 168 of the Heating, Ventilation, and Air Conditioning (HVAC) system. Accordingly, the fifth heat exchanger 208 may be employed to alter a temperature and/or a humidity of ambient air and provide temperature-controlled and/or humidity-controlled air to an environment (e.g., a cabin of a vehicle). The second region 192 of the first heat exchanger 44 is immediately downstream of the pump 188. The reservoir 196 is immediately downstream of the second region 192 of the first heat exchanger 44. The fifth heat exchanger 208 is downstream of the reservoir 196.

Referring still further to FIGS. 1-18, a first three-way valve 216, a second three-way valve 220, and a third three-way valve 224 are each positioned between the reservoir 196 and the fifth heat exchanger 208. The first three-way valve 216 is positioned immediately downstream of the reservoir 196. The first three-way valve 216 is immediately upstream of the second heat-producing component 204 and may control flow of the second heat exchange fluid to the second heat-producing component 204. The second three-way valve 220 is immediately downstream of the first three-way valve 216. The second three-way valve 220 is also immediately downstream of the second heat-producing component 204. The third three-way valve 224 is immediately downstream of the second three-way valve 220. The third three-way valve 224 is immediately upstream of the first heat-producing component 200. The third three-way valve 224 is also immediately upstream of the fifth heat exchanger 208. A fourth three-way valve 228 is positioned immediately downstream of the first heat-producing component 200. The fourth three-way valve 228 is also positioned immediately downstream of the fifth heat exchanger 208. The first heat-producing component 200 and the fifth heat exchanger 208 are plumbed in parallel with one another. The fourth three-way valve 228 is immediately upstream of the pump 188. The first heat-producing component 200 is in direct fluid communication with the fourth heat exchanger 156. Accordingly, the fourth heat exchanger 156 may exchange heat between the first heat exchange fluid and the second heat exchange fluid. Alternatively, the fourth heat exchanger 156 may exchange heat between the first heat exchange fluid and a third heat exchange fluid, with the third heat exchange fluid circulating between the first heat-producing component 200 and the fourth heat exchanger 156.

Referring now to FIGS. 2-18, in each of these modes of operation, the compressor 28 acts upon the first heat exchange fluid (e.g., a refrigerant) that is circulated through the refrigerant loop 24. Accordingly, the action of the compressor 28 drives the first heat exchange fluid from the outlet 40 of the compressor 28 toward an inlet 232 of the first region 48 of the first heat exchanger 44. Within the first heat exchanger 44, the first heat exchange fluid thermally interacts with a second heat exchange fluid that is circulated through the coolant loop 184 by way of the second region 192 of the first heat exchanger 44, as will be discussed in further detail herein. The first heat exchange fluid exits the first region 48 of the first heat exchanger 44 by way of an outlet 236 thereof. From the outlet 236 of the first region 48 of the first heat exchanger 44, the first heat exchange fluid is directed toward the first branching point 52.

Figure 2:
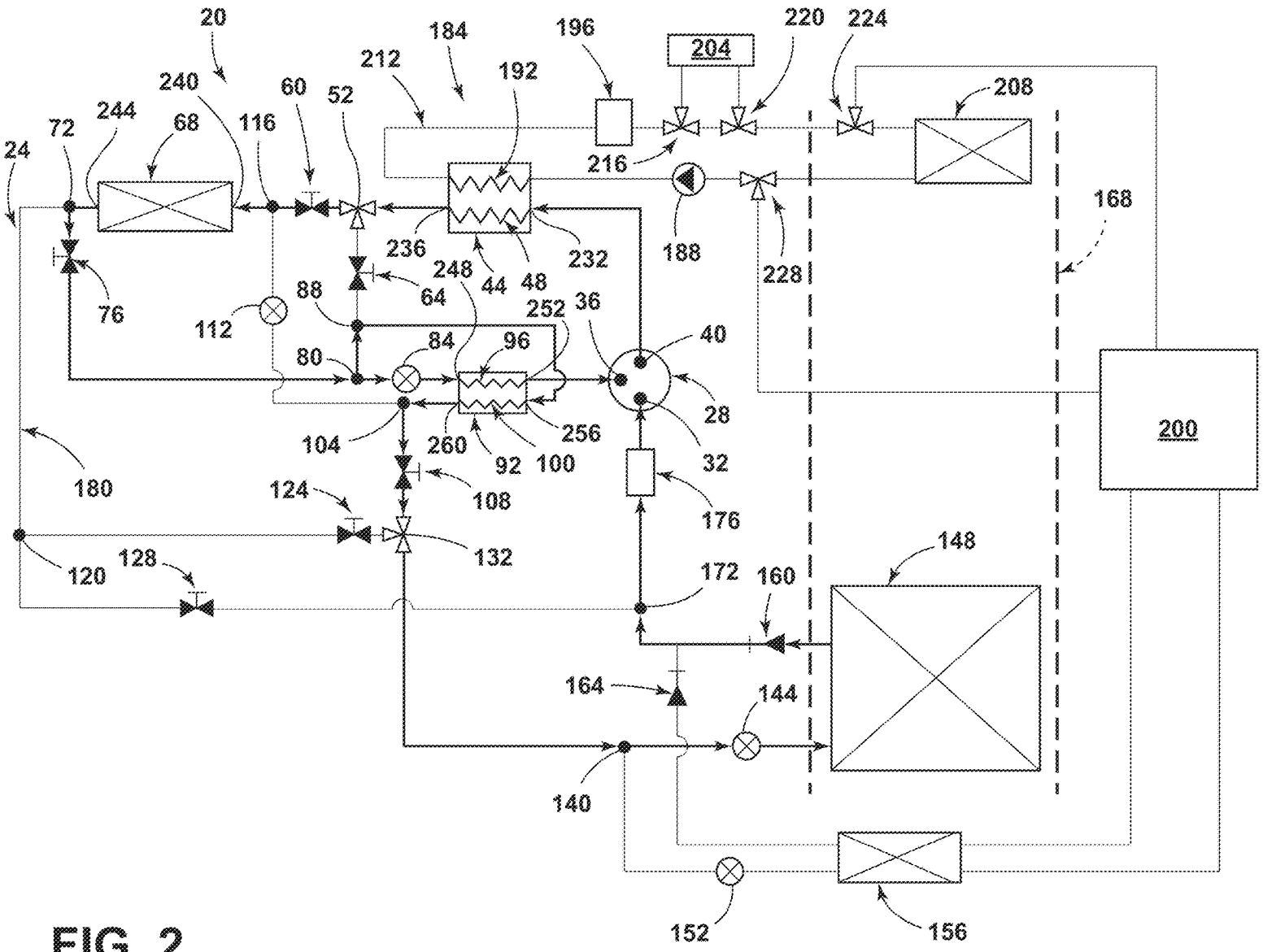
FIG. 2 is a schematic representation of the heat pump arrangement, illustrating a cabin cooling mode of operation, according to one example.
Figure 3:
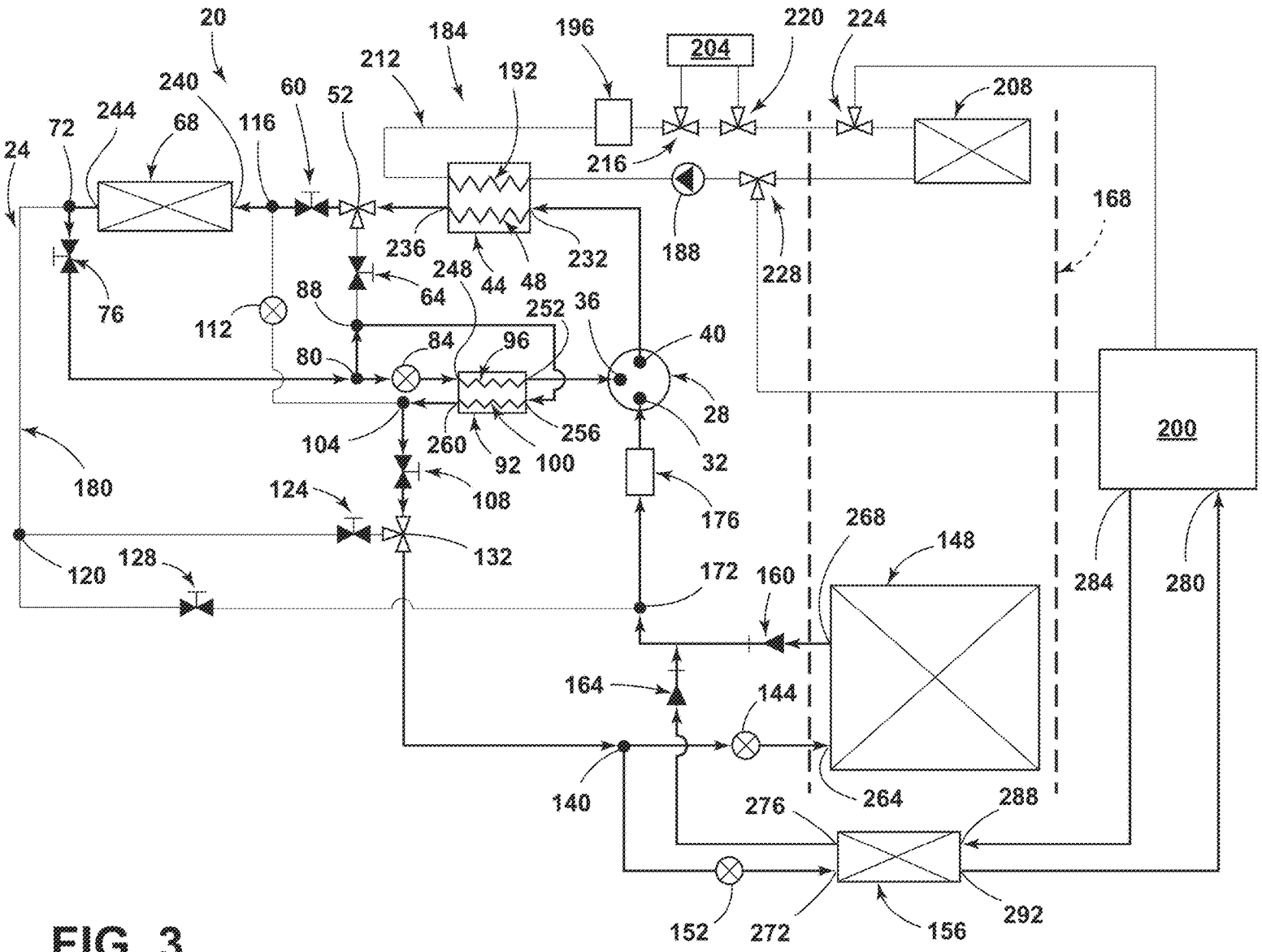
FIG. 3 is a schematic representation of the heat pump arrangement, illustrating a cabin and battery cooling mode of operation, according to one example.
Figure 4:
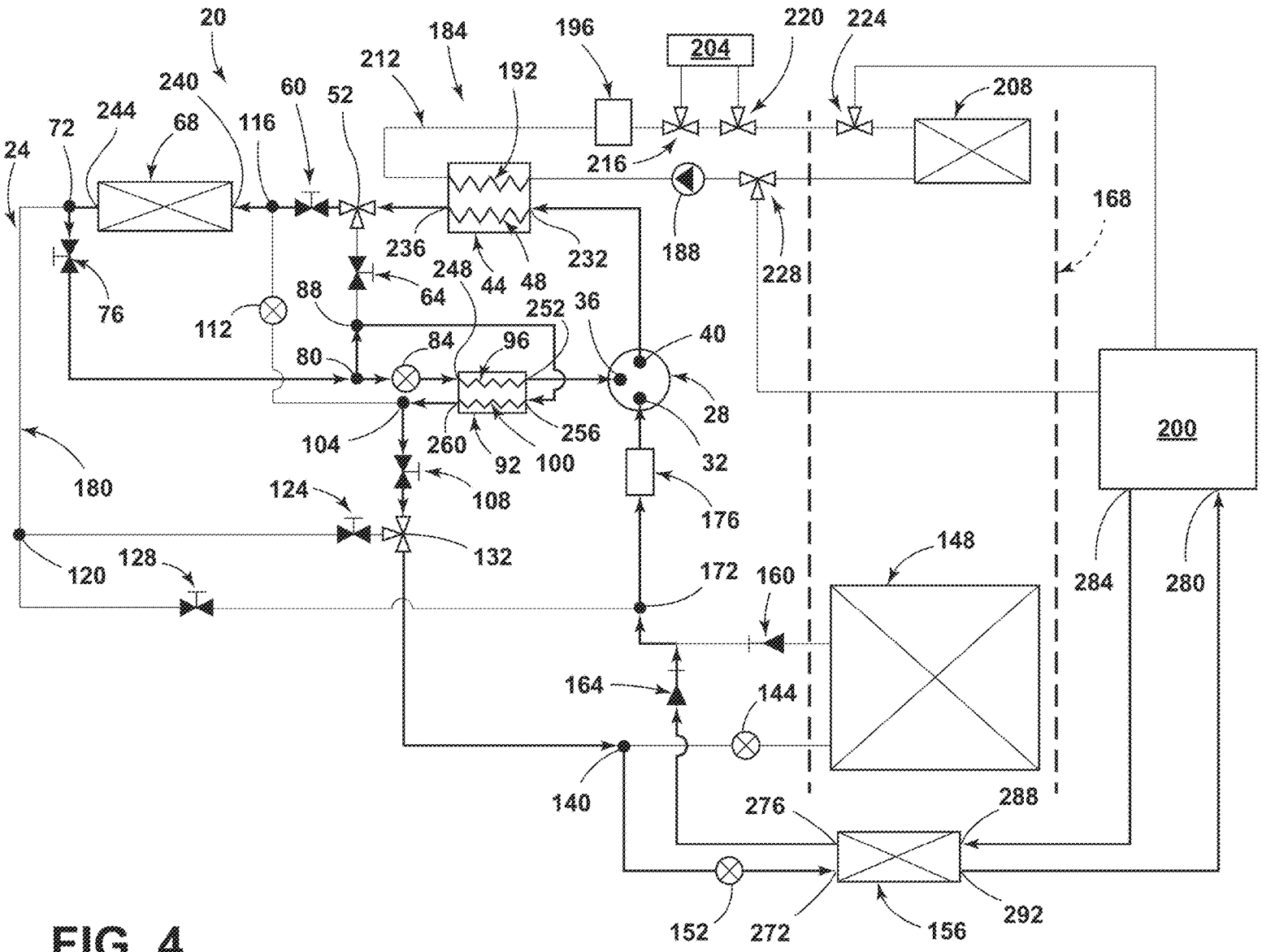
FIG. 4 is a schematic representation of the heat pump arrangement, illustrating a battery cooling mode of operation, according to one example.
Figure 5:
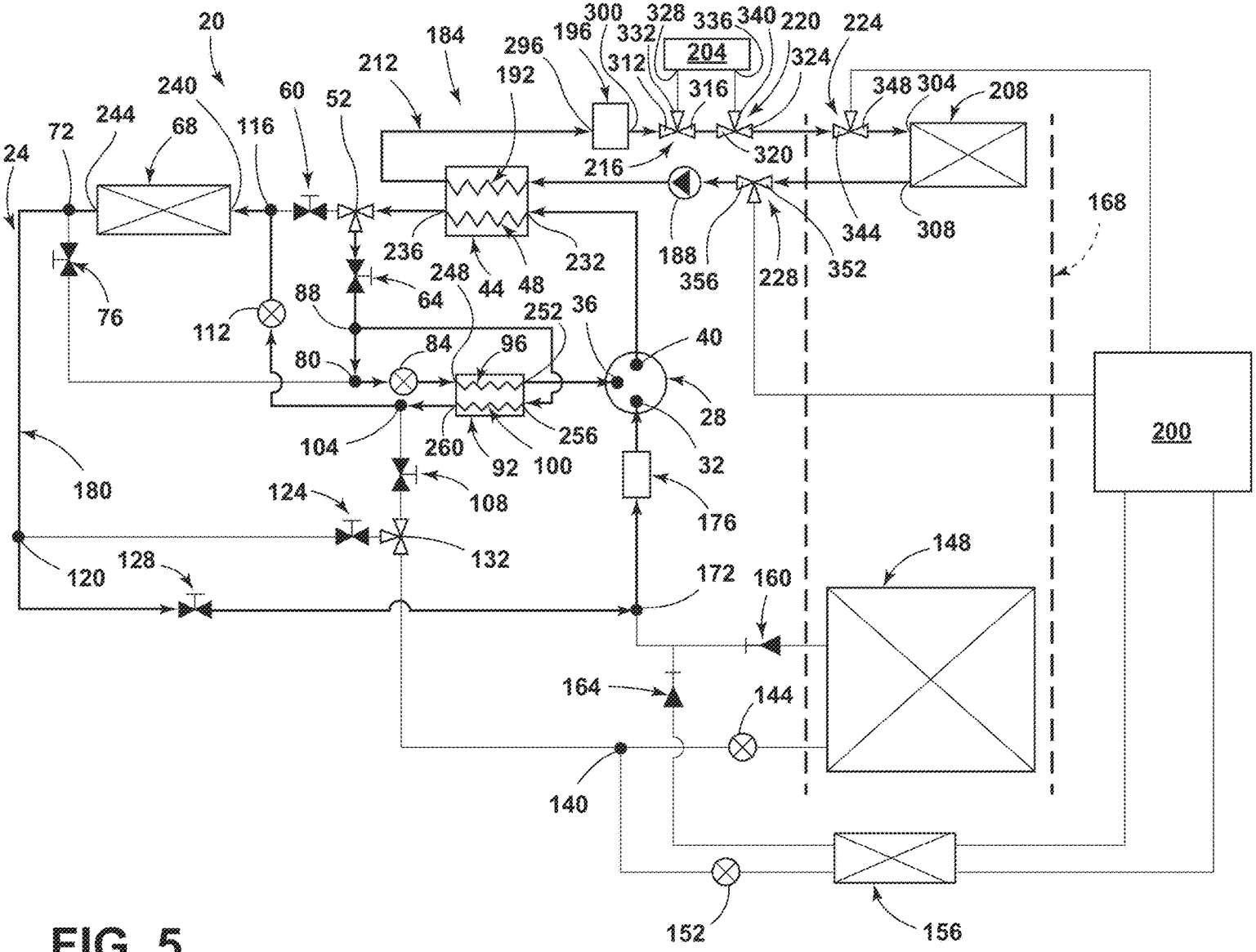
FIG. 5 is a schematic representation of the heat pump arrangement, illustrating a cabin heating mode of operation, according to one example.

Referring to FIGS. 2-4, a cabin cooling mode of operation (FIG. 2), a cabin and battery cooling mode of operation (FIG. 3), and a battery cooling mode of operation (FIG. 4) are each depicted in exemplary form. In each of these modes of operation, the second shutoff valve 64 is in a closed position and the first shutoff valve 60 is in an open position. Accordingly, from the first branching point 52, the first heat exchange fluid is directed to the first shutoff valve 60. After flowing through the first shutoff valve 60, the first heat exchange fluid is directed toward an inlet 240 of the second heat exchanger 68. On the way to the inlet 240 of the second heat exchanger 68, the first heat exchange fluid passes through the first coupling point 116. As the first heat exchange fluid flows through the second heat exchanger 68, the first heat exchange fluid may thermally interact with a heat exchange fluid that is external to the refrigerant loop 24 and the coolant loop 184 (e.g., ambient air) such that heat may be removed from the first heat exchange fluid. In alternative modes of operation, at the second heat exchanger 68, the first heat exchange fluid may absorb heat from the heat exchange fluid that is external to the refrigerant loop 24 and the coolant loop 184. The flow of heat to or from the first heat exchange fluid at the second heat exchanger 68 depends upon the particular mode of operation and the thermal conditions of the heat exchange fluid that is external to the refrigerant loop 24 and the coolant loop 184. The first heat exchange fluid exits the second heat exchanger 68 at an outlet 244 of the second heat exchanger 68.

Referring again to FIGS. 2-4, the fifth and sixth shutoff valves 124, 128 are each in a closed position in each of these modes of operation. The third shutoff valve 76 is in an open position in each of these modes of operation. Accordingly, after exiting the second heat exchanger 68 by way of the outlet 244, the first heat exchange fluid encounters the second branching point 72 and is directed toward the third shutoff valve 76 by the refrigerant network of conduits 180. The first heat exchange fluid passes through the third shutoff valve 76 and continues on toward the intersection point 80. In these modes of operation, the intersection point 80 behaves as a branching point such that the first heat exchange fluid is split between a first path and a second path that each extend from the intersection point 80. A first portion of the first heat exchange fluid that encounters the intersection point 80 is directed along the first path toward the first expansion valve 84. As a result of interaction with the first expansion valve 84, the first portion of the first heat exchange fluid decreases in pressure and temperature. From the first expansion valve 84, the first portion of the first heat exchange fluid is directed toward an inlet 248 of the first region 96 of the vapor generator 92. The first portion of the first heat exchange fluid flows through the first region 96 of the vapor generator 92 and exits the first region 96 by way of an outlet 252 thereof. While within the first region 96 of the vapor generator 92, the first portion of the first heat exchange fluid thermally interacts with a second portion of the first heat exchange fluid.

Referring further to FIGS. 2-4, the second portion of the first heat exchange fluid is the portion of the first heat exchange fluid that was directed along the second path from the intersection point 80. The second portion of the first heat exchange fluid that encounters the intersection point 80 is directed along the second path toward the third branching point 88. With the second shutoff valve 64 in the closed position in these modes of operation, an entirety of the second portion of the first heat exchange fluid that encounters the third branching point 88 is directed toward an inlet 256 of the second region 100 of the vapor generator 92. The second portion of the first heat exchange fluid flows through the second region 100 of the vapor generator 92 and exits the second region 100 by way of an outlet 260 thereof. Due to the interaction with the first expansion valve 84, the first portion of the first heat exchange fluid within the first region 96 has a lower temperature and pressure than the second portion of the first heat exchange fluid within the second region 100. Therefore, the first heat exchange fluid within the first region 96 thermally interacts with the first heat exchange fluid flowing through the second region 100 of the vapor generator 92 such that a temperature, a pressure, and/or a vapor percentage of the first portion of the first heat exchange fluid is increased as a result of interaction with the vapor generator 92. The first heat exchange fluid that exits the first region 96 by way of the outlet 252 is directed toward the mid-pressure inlet 36 of the compressor 28. The first heat exchange fluid from the first region 96 of the vapor generator 92 is injected into the compressor 28. The injection of the first heat exchange fluid at the mid-pressure inlet 36 of the compressor 28 can improve efficiency of the refrigerant loop 24 and/or increase a heat exchange capacity of the refrigerant loop 24. For example, the injection of the first heat exchange fluid at the mid-pressure inlet 36 of the compressor 28 can increase a condensing capacity of the refrigerant loop 24 while decreasing a load experienced by the compressor 28. The improved condensing capacity of the refrigerant loop 24 and the decreased load on the compressor 28 can contribute to performance and efficiency improvements for the heat pump 20 and/or the refrigerant loop 24. Additionally, the injection of the first heat exchange fluid at the mid-pressure inlet 36 can increase an ambient temperature operating range of the heat pump 20 and/or the refrigerant loop 24.

Referring still further to FIGS. 2-4, in various examples, the portion of the first heat exchange fluid that is directed toward the first expansion valve 84 can be expressed as a ratio or percentage. For example, expressing the ratio as a percentage of the first heat exchange fluid that is directed toward the first expansion valve 84, the first expansion valve 84 can receive about 5%, about 10%, about 15%, about 20%, about 25%, about 30%, about 35%, about 40%, about 45%, about 50%, about 55%, or about 60% of the first heat exchange fluid that encounters the intersection point 80. The remainder, or balancing percentage, of the first heat exchange fluid that encounters the intersection point 80 and is not directed toward the first expansion valve 84 continues toward the second region 100 of the vapor generator 92. It is contemplated that in different modes of operation of the heat pump 20, the percentage of the first heat exchange fluid that is received by the first expansion valve 84 may vary.

Referring again to FIGS. 2-4, the second expansion valve 112 operates as a shutoff valve that is in the closed position and the fourth shutoff valve 108 is in the open position in each of these modes of operation. Accordingly, the second portion of the first heat exchange fluid, which exits the second region 100 of the vapor generator 92 by way of the outlet 260, is directed toward the fourth shutoff valve 108 when the second portion of the first heat exchange fluid encounters the fourth branching point 104. From the fourth shutoff valve 108, the first heat exchange fluid is directed toward the second coupling point 132. With the fifth and sixth shutoff valves 124, 128 each in the closed position, when the first heat exchange fluid encounters the second coupling point 132, the first heat exchange fluid is directed toward the sixth branching point 140. As stated above, the refrigerant loop 24 splits into two paths at the sixth branching point 140. The third expansion valve 144 is positioned immediately downstream of the sixth branching point 140 along the first path that extends from the sixth branching point 140. The fourth expansion valve 152 is positioned immediately downstream of the sixth branching point 140 along the second path that extends from the sixth branching point 140. For the time being, focus is directed toward the first path that leads toward the third heat exchanger 148. From the sixth branching point 140, at least a portion of the first heat exchange fluid is directed to the third expansion valve 144. The first heat exchange fluid decreases in pressure and temperature as a result of interaction with the third expansion valve 144. From the third expansion valve 144, the first heat exchange fluid is directed to an inlet 264 of the third heat exchanger 148.

Referring further to FIGS. 2-4, the decreased temperature and pressure of the first heat exchange fluid flowing through the third heat exchanger 148 can be employed to provide cooling to air that is flowing through the ductwork 168 with which the third heat exchanger 148 is in fluid communication. Accordingly, the first heat exchange fluid that exits the third heat exchanger 148 by way of an outlet 268 of the third heat exchanger 148 may have an increased pressure, temperature, and/or vapor percentage when compared to the first heat exchange fluid that entered the third heat exchanger 148 at the inlet 264. Upon exiting the third heat exchanger 148 by way of the outlet 268, the first heat exchange fluid flows through the first check valve 160. After exiting the first check valve 160, the first heat exchange fluid is directed toward the accumulator 176 by the refrigerant network of conduits 180. In the mode of operation depicted in FIG. 2, the second check valve 164 prevents backflow toward the fourth heat exchanger 156. Accordingly, the fourth heat exchanger 156 is prevented from becoming a storage vessel for the first heat exchange fluid when the fourth heat exchanger 156 is not employed in a given mode of operation. From the first check valve 160, the first heat exchange fluid flows toward the accumulator 176. On the way to the accumulator 176, the first heat exchange fluid flows through the third coupling point 172. The accumulator 176 receives the first heat exchange fluid and provides a gaseous component of the first heat exchange fluid to the low-pressure inlet 32 of the compressor 28.

Referring particularly to FIGS. 3 and 4, in the mode of operation depicted in FIG. 3, the first heat exchange fluid is split into a first portion that follows the first path in the manner described above and a second portion that follows the second path, as will be described below. In the mode of operation depicted in FIG. 4, an entirety of the first heat exchange fluid that encounters the sixth branching point 140 is directed along the second path toward the fourth heat exchanger 156. From the sixth branching point 140, at least a portion of the first heat exchange fluid is directed toward the fourth heat exchanger 156. Prior to reaching the fourth heat exchanger 156, the first heat exchange fluid encounters the fourth expansion valve 152. The first heat exchange fluid decreases in pressure and temperature as a result of interaction with the fourth expansion valve 152. From the fourth expansion valve 152, the first heat exchange fluid is directed to a first inlet 272 of the fourth heat exchanger 156. The decreased temperature and pressure of the first heat exchange fluid that was provided by the fourth expansion valve 152 may be employed to provide cooling to a second, or third, heat exchange fluid that is also flowing through the fourth heat exchanger 156, as will be discussed further herein. Therefore, the first heat exchange fluid that exits the fourth heat exchanger 156 by way of a first outlet 276 thereof may have an increased pressure, temperature, and/or vapor percentage when compared to the first heat exchange fluid that entered the fourth heat exchanger 156 at the first inlet 272.

Referring again to FIGS. 3 and 4, from the first outlet 276 of the fourth heat exchanger 156, the first heat exchange fluid is directed to the second check valve 164 by the refrigerant network of conduits 180. The first heat exchange fluid flows through the second check valve 164 and is directed toward the accumulator 176. In the mode of operation depicted in FIG. 3, after exiting the second check valve 164, the second portion of the first heat exchange fluid is rejoined, or recombined, with the first portion of the first heat exchange fluid prior to reaching the accumulator 176. In the mode of operation depicted in FIG. 4, the first check valve 160 prevents back flow toward the third heat exchanger 148. Accordingly, the third heat exchanger 148 is prevented from becoming a storage vessel for the first heat exchange fluid when the third heat exchanger 148 is not employed in a given mode of operation. On the way to the accumulator 176, the first heat exchange fluid passes through the third coupling point 172. The accumulator 176 receives the first heat exchange fluid and performs as described above, thereby completing the traversal of the refrigerant loop 24.

Referring further to FIGS. 3 and 4, the second, or third, heat exchange fluid flows between the fourth heat exchanger 156 and the first heat-producing component 200. More specifically, a first inlet 280 of the first heat-producing component 200 receives the second, or third, heat exchange fluid from the fourth heat exchanger 156. The first heat-producing component 200 can be an engine, electronics, battery, battery pack, one or more heating elements, brakes, or the like. The second, or third, heat exchange fluid received at the first inlet 280 of the first heat-producing component 200 can decrease a temperature of the first heat-producing component 200. More specifically, the decreased temperature, pressure, and/or vapor percentage provided to the first heat exchange fluid flowing through the fourth heat exchanger 156 as a result of interaction with the fourth expansion valve 152 can be employed for thermal exchange with the second, or third, heat exchange fluid. Accordingly, the second, or third, heat exchange fluid that exits the fourth heat exchanger 156 may have a decreased temperature, pressure, and/or vapor percentage when compared to the second, or third, heat exchange fluid that entered the fourth heat exchanger 156. Therefore, the second, or third, heat exchange fluid that exits the first heat-producing component 200 by way of a first outlet 284 thereof may have a greater pressure, temperature, and/or vapor percentage than the second, or third, heat exchange fluid that was received at the first inlet 280. The first heat-producing component 200 is further plumbed to the coolant loop 184, as will be discussed in further detail herein.

Referring still further to FIGS. 3 and 4, from the first outlet 284 of the first heat-producing component 200, the second, or third, heat exchange fluid is directed toward a second inlet 288 of the fourth heat exchanger 156. The first heat exchange fluid received at the first inlet 272 and the second, or third, heat exchange fluid received at the second inlet 288 can thermally interact with one another within the fourth heat exchanger 156. The second, or third, heat exchange fluid that is received at the second inlet 288 exits the fourth heat exchanger 156 by way of a second outlet 292 thereof. From the second outlet 292 of the fourth heat exchanger 156, the second, or third, heat exchange fluid is directed back toward the first inlet 280 of the first heat-producing component 200. In each of these modes of operation, the first heat-producing component 200 may be cooled as a result of the thermal exchange between the first heat exchange fluid and the second, or third, heat exchange fluid.

Referring now to FIGS. 5-9, a cabin heating mode of operation (FIG. 5), a battery heating mode of operation (FIG. 6), a cabin and battery heating mode of operation (FIG. 7), a cabin heating and battery cooling with serial evaporation mode of operation (FIG. 8), and a cabin heating and battery cooling with parallel evaporation mode of operation (FIG. 9) are each depicted in exemplary form. In each of these modes of operation, the first shutoff valve 60 is in the closed position and the second shutoff valve 64 is in the open position. Accordingly, when the first heat exchange fluid encounters the first branching point 52 after exiting the first region 48 of the first heat exchanger 44, the first heat exchange fluid is directed toward the second shutoff valve 64. After flowing through the second shutoff valve 64, the first heat exchange fluid is directed toward the third branching point 88. At the third branching point 88, the refrigerant loop 24 splits into a first path and a second path. The intersection point 80 is positioned immediately downstream of the third branching point 88 along the first path and receives a first portion of the first heat exchange fluid that encounters the third branching point 88. The second region 100 of the vapor generator 92 is positioned immediately downstream of the third branching point 88 along the second path and receives a second portion of the first heat exchange fluid that encounters the third branching point 88.

Referring again to FIGS. 5-9, in these modes of operation, the intersection point 80 behaves as a coupling point. The first portion of the first heat exchange fluid is received at the intersection point 80 and directed toward the first expansion valve 84. As a result of interaction with the first expansion valve 84, the first portion of the first heat exchange fluid decreases in pressure and temperature. From the first expansion valve 84, the first portion of the first heat exchange fluid is directed toward the inlet 248 of the first region 96 of the vapor generator 92. The first portion of the first heat exchange fluid flows through the first region 96 of the vapor generator 92 and exits the first region 96 by way of the outlet 252 thereof. While within the first region 96 of the vapor generator 92, the first portion of the first heat exchange fluid thermally interacts with the second portion of the first heat exchange fluid in the manner already described. The first heat exchange fluid that exits the first region 96 by way of the outlet 252 is directed toward the mid-pressure inlet 36 of the compressor 28. The first heat exchange fluid from the first region 96 of the vapor generator 92 is injected into the compressor 28.

Referring further to FIGS. 5-9, the second portion of the first heat exchange fluid is received at the inlet 256 of the second region 100 of the vapor generator 92. The second portion of the first heat exchange fluid passes through the second region 100 and thermally interacts with the first portion passing through the first region 96 in the manner already described. The second portion of the first heat exchange fluid exits the second region 100 by way of the outlet 260 thereof and is directed toward the fourth branching point 104. In the modes of operation depicted in FIGS. 5-8, the fourth shutoff valve 108 is in the closed position. Accordingly, in the modes of operation depicted in FIGS. 5-8, an entirety of the first heat exchange fluid that encounters the fourth branching point 104 is directed toward the second expansion valve 112. In the mode of operation depicted in FIG. 9, the fourth shutoff valve 108 is in the open position. Accordingly, in the mode of operation depicted in FIG. 9, a first portion of the first heat exchange fluid that encounters the fourth branching point 104 is directed along the first path that leads toward the fourth shutoff valve 108 and a second portion of the first heat exchange fluid that encounters the fourth branching point 104 is directed along the second path that leads toward the second expansion valve 112. The flow of the first portion of the first heat exchange fluid that encounters the fourth branching point 104 will be discussed in further detail herein with regard to FIG. 9.

Referring still further to FIGS. 5-9, at least a portion of the first heat exchange fluid that encounters the fourth branching point 104 is received by the second expansion valve 112. As a result of interaction with the second expansion valve 112, the first heat exchange fluid decreases in pressure and temperature. From the second expansion valve 112, the first heat exchange fluid is directed toward the first coupling point 116. In each of these modes of operation, the first shutoff valve 60 is in the closed position. Accordingly, the first heat exchange fluid received at the first coupling point 116 is directed toward the inlet 240 of the second heat exchanger 68. The second heat exchanger 68 performs as already described. The first heat exchange fluid exits the second heat exchanger 68 by way of the outlet 244 thereof. The third shutoff valve 76 is in the closed position in each of these modes of operation.

With particular reference to the modes of operation depicted in FIGS. 5-7 and 9, the fifth shutoff valve 124 is in the closed position and the sixth shutoff valve 128 is in the open position. Accordingly, from the outlet 244 of the second heat exchanger 68, the first heat exchange fluid is directed toward the sixth shutoff valve 128. After flowing through the sixth shutoff valve 128, the first heat exchange fluid is directed toward the third coupling point 172. From the third coupling point 172, the first heat exchange fluid is directed toward the accumulator 176. The accumulator 176 performs as already described and delivers a gaseous component of the first heat exchange fluid to the low-pressure inlet 32 of the compressor 28.

Figure 8:
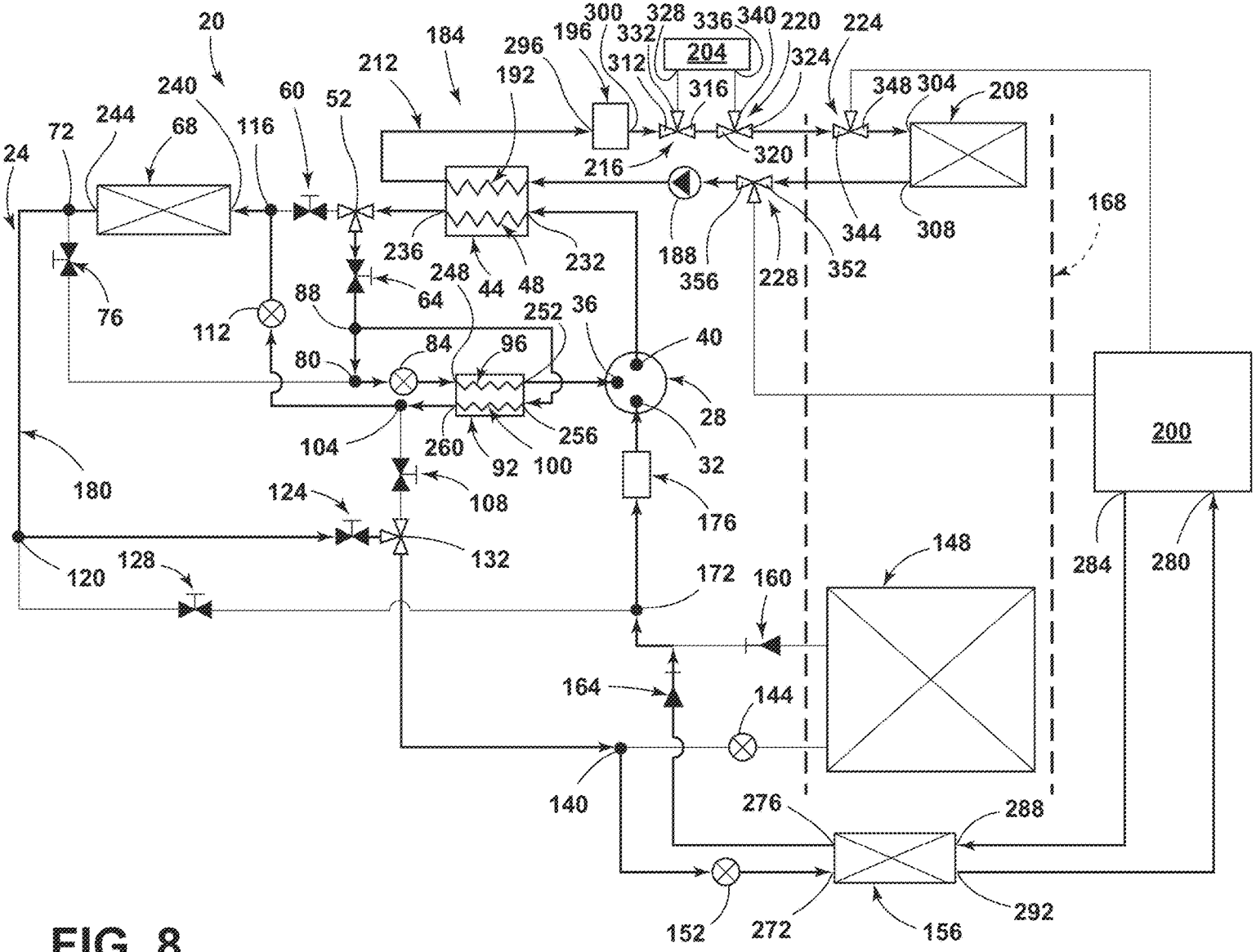
FIG. 8 is a schematic representation of the heat pump arrangement, illustrating a cabin heating and battery cooling with serial evaporation mode of operation, according to one example.

With specific reference to FIG. 8, the fifth shutoff valve 124 is in the open position and the sixth shutoff valve 128 is in the closed position. Accordingly, from the outlet 244 of the second heat exchanger 68, the first heat exchange fluid is directed toward the fifth shutoff valve 124. After flowing through the fifth shutoff valve 124, the first heat exchange fluid is directed to the second coupling point 132. From the second coupling point 132, the first heat exchange fluid is directed toward the sixth branching point 140.

Figure 9:
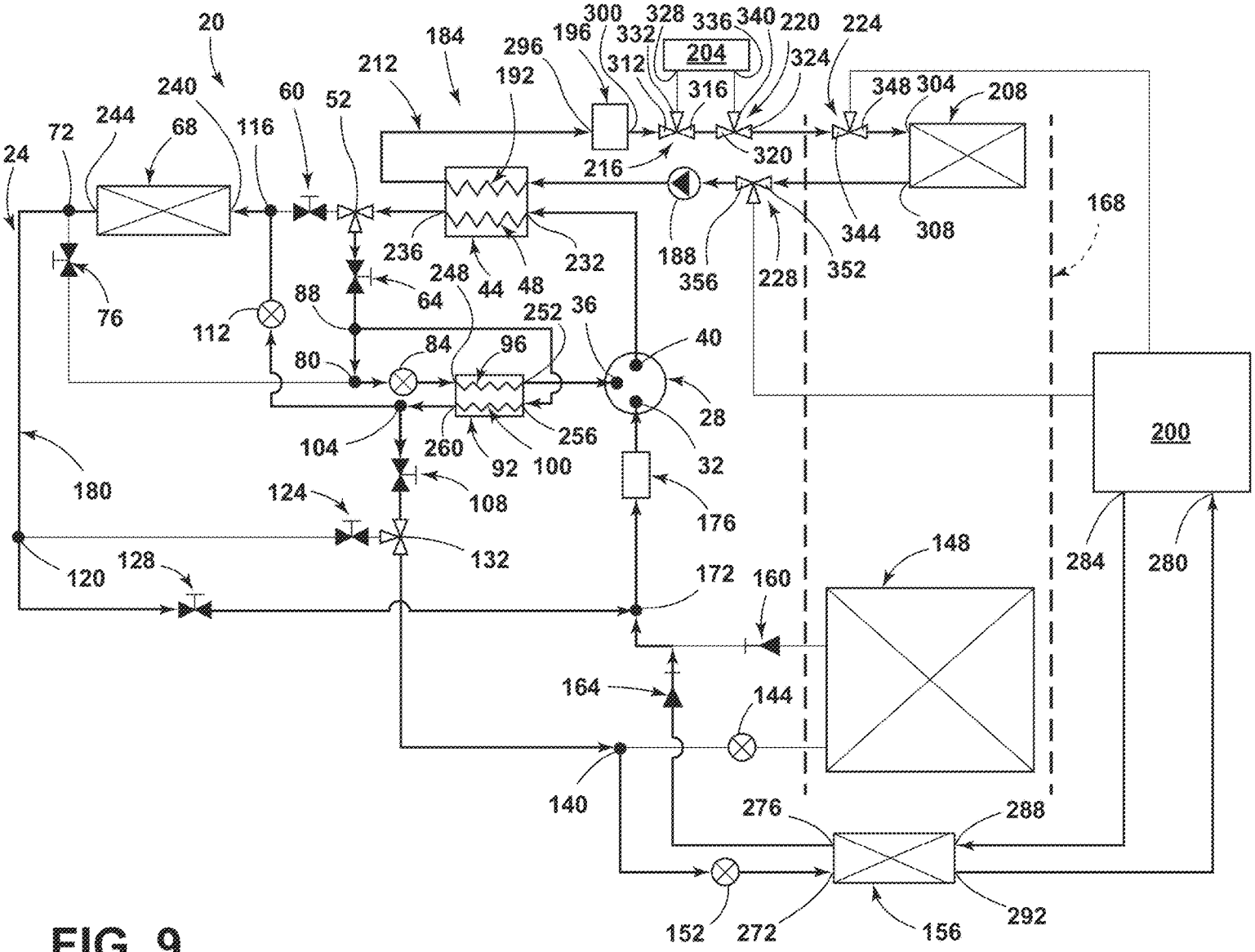
FIG. 9 is a schematic representation of the heat pump arrangement, illustrating a cabin heating and battery cooling with parallel evaporation mode of operation, according to one example.

Referring particularly to FIG. 9, the fourth shutoff valve 108 is in the open position. Accordingly, as mentioned above, the first heat exchange fluid is split into a first portion and a second portion at the fourth branching point 104. The flow of the second portion that is directed toward the second expansion valve 112 has been described above. The first portion of the first heat exchange fluid that encountered the fourth branching point 104 flows through the fourth shutoff valve 108 and the second coupling point 132. From the second coupling point 132, the first portion of the first heat exchange fluid is directed toward the sixth branching point 140.

Referring now to FIGS. 8 and 9, the first heat exchange fluid that is received at the sixth branching point 140 is directed toward the fourth heat exchanger 156. Prior to reaching the fourth heat exchanger 156, the first heat exchange fluid encounters the fourth expansion valve 152. The first heat exchange fluid decreases in pressure and temperature as a result of interaction with the fourth expansion valve 152. From the fourth expansion valve 152, the first heat exchange fluid is directed to the first inlet 272 of the fourth heat exchanger 156. The decreased temperature and pressure of the first heat exchange fluid that was provided by the fourth expansion valve 152 may be employed to provide cooling to the second, or third, heat exchange fluid that is also flowing through the fourth heat exchanger 156, as was discussed above. Therefore, the first heat exchange fluid that exits the fourth heat exchanger 156 by way of the first outlet 276 thereof may have an increased pressure, temperature, and/or vapor percentage when compared to the first heat exchange fluid that entered the fourth heat exchanger 156 at the first inlet 272.

Referring again to FIGS. 8 and 9, from the first outlet 276 of the fourth heat exchanger 156, the first heat exchange fluid is directed to the second check valve 164 by the refrigerant network of conduits 180. The first heat exchange fluid flows through the second check valve 164 and is directed toward the accumulator 176. The first check valve 160 prevents back flow toward the third heat exchanger 148. Accordingly, the third heat exchanger 148 is prevented from becoming a storage vessel for the first heat exchange fluid when the third heat exchanger 148 is not employed in a given mode of operation. On the way to the accumulator 176, the first heat exchange fluid passes through the third coupling point 172. In the mode of operation depicted in FIG. 9, at the third coupling point 172, the first heat exchange fluid that exits the second check valve 164 is recombined with the first heat exchange fluid that exits the sixth shutoff valve 128. The accumulator 176 receives the first heat exchange fluid from the third coupling point 172 and performs as described above.

Referring further to FIGS. 8 and 9, the second, or third, heat exchange fluid flows between the fourth heat exchanger 156 and the first heat-producing component 200. More specifically, the first inlet 280 of the first heat-producing component 200 receives the second, or third, heat exchange fluid from the second outlet 292 of the fourth heat exchanger 156. The second, or third, heat exchange fluid received at the first inlet 280 of the first heat-producing component 200 can decrease a temperature of the first heat-producing component 200. More specifically, the decreased temperature, pressure, and/or vapor percentage provided to the first heat exchange fluid flowing through the fourth heat exchanger 156 as a result of interaction with the fourth expansion valve 152 can be employed for thermal exchange with the second, or third, heat exchange fluid. Accordingly, the second, or third, heat exchange fluid that exits the fourth heat exchanger 156 may have a decreased temperature, pressure, and/or vapor percentage when compared to the second, or third, heat exchange fluid that entered the fourth heat exchanger 156. Therefore, the second, or third, heat exchange fluid that exits the first heat-producing component 200 by way of the first outlet 284 thereof may have a greater pressure, temperature, and/or vapor percentage than the second, or third, heat exchange fluid that was received at the first inlet 280. The first heat-producing component 200 is further plumbed to the coolant loop 184, as will be discussed in further detail herein.

Referring still further to FIGS. 8 and 9, from the first outlet 284 of the first heat-producing component 200, the second, or third, heat exchange fluid is directed toward the second inlet 288 of the fourth heat exchanger 156. The first heat exchange fluid received at the first inlet 272 and the second, or third, heat exchange fluid received at the second inlet 288 can thermally interact with one another within the fourth heat exchanger 156. The second, or third, heat exchange fluid that is received at the second inlet 288 exits the fourth heat exchanger 156 by way of the second outlet 292 thereof. From the second outlet 292 of the fourth heat exchanger 156, the second, or third, heat exchange fluid is directed back toward the first inlet 280 of the first heat-producing component 200. In each of these modes of operation, the first heat-producing component 200 may be cooled as a result of the thermal exchange between the first heat exchange fluid and the second, or third, heat exchange fluid.

Referring now to FIGS. 10-11 and 17-18, a reheat mode of operation (FIG. 10), a reheat and battery cooling mode of operation (FIG. 11), a de-ice and battery cooling mode of operation (FIG. 17), and a cabin heating, de-ice, and battery cooling mode of operation (FIG. 18) are each depicted in exemplary form. The reheat portions of the modes of operation discussed herein may alternatively be referred to as a dehumidification portion of the given mode of operation. For example, the mode of operation depicted in FIG. 10 may alternatively be referred to as a dehumidification mode of operation. In each of the modes of operation depicted in FIGS. 10-11 and 17-18, the second shutoff valve 64 is in a closed position and the first shutoff valve 60 is in an open position. Accordingly, from the first branching point 52, the first heat exchange fluid is directed to the first shutoff valve 60. After flowing through the first shutoff valve 60, the first heat exchange fluid is directed toward the inlet 240 of the second heat exchanger 68. On the way to the inlet 240 of the second heat exchanger 68, the first heat exchange fluid passes through the first coupling point 116. The first heat exchange fluid flows through the second heat exchanger 68 and the second heat exchanger 68 performs as already described. The flow of heat to or from the first heat exchange fluid at the second heat exchanger 68 depends upon the particular mode of operation and the thermal conditions of the heat exchange fluid that is external to the refrigerant loop 24 and the coolant loop 184. The first heat exchange fluid exits the second heat exchanger 68 at the outlet 244 of the second heat exchanger 68.

Referring again to FIGS. 10-11 and 17-18, the fifth and sixth shutoff valves 124, 128 are each in a closed position in each of these modes of operation. The third shutoff valve 76 is in an open position in each of these modes of operation. Accordingly, after exiting the second heat exchanger 68 by way of the outlet 244, the first heat exchange fluid encounters the second branching point 72 and is directed toward the third shutoff valve 76 by the refrigerant network of conduits 180. The first heat exchange fluid passes through the third shutoff valve 76 and continues on toward the intersection point 80. In these modes of operation, the intersection point 80 behaves as a branching point such that the first heat exchange fluid is split between the first path and the second path that each extend from the intersection point 80. A first portion of the first heat exchange fluid that encounters the intersection point 80 is directed along the first path toward the first expansion valve 84. The first expansion valve 84 performs as already described. From the first expansion valve 84, the first portion of the first heat exchange fluid is directed toward the inlet 248 of the first region 96 of the vapor generator 92. The first portion of the first heat exchange fluid flows through the first region 96 of the vapor generator 92 and exits the first region 96 by way of the outlet 252 thereof. While within the first region 96 of the vapor generator 92, the first portion of the first heat exchange fluid thermally interacts with a second portion of the first heat exchange fluid.

Referring further to FIGS. 10-11 and 17-18, the second portion of the first heat exchange fluid is the portion of the first heat exchange fluid that was directed along the second path from the intersection point 80. The second portion of the first heat exchange fluid that encounters the intersection point 80 is directed along the second path toward the third branching point 88. With the second shutoff valve 64 in the closed position in these modes of operation, an entirety of the second portion of the first heat exchange fluid that encounters the third branching point 88 is directed toward the inlet 256 of the second region 100 of the vapor generator 92. The second portion of the first heat exchange fluid flows through the second region 100 of the vapor generator 92 and exits the second region 100 by way of the outlet 260 thereof. The vapor generator 92 performs as already described. The first heat exchange fluid that exits the first region 96 by way of the outlet 252 is directed toward the mid-pressure inlet 36 of the compressor 28.

Referring still further to FIGS. 10-11 and 17-18, in various examples, the portion of the first heat exchange fluid that is directed toward the first expansion valve 84 can be expressed as a ratio or percentage. For example, expressing the ratio as a percentage of the first heat exchange fluid that is directed toward the first expansion valve 84, the first expansion valve 84 can receive about 5%, about 10%, about 15%, about 20%, about 25%, about 30%, about 35%, about 40%, about 45%, about 50%, about 55%, or about 60% of the first heat exchange fluid that encounters the intersection point 80. The remainder, or balancing percentage, of the first heat exchange fluid that encounters the intersection point 80 and is not directed toward the first expansion valve 84 continues toward the second region 100 of the vapor generator 92. It is contemplated that in different modes of operation of the heat pump 20, the percentage of the first heat exchange fluid that is received by the first expansion valve 84 may vary.

Referring again to FIGS. 10-11 and 17-18, the second expansion valve 112 operates as a shutoff valve that is in the closed position and the fourth shutoff valve 108 is in the open position in each of these modes of operation. Accordingly, the second portion of the first heat exchange fluid, which exits the second region 100 of the vapor generator 92 by way of the outlet 260, is directed toward the fourth shutoff valve 108 when the second portion of the first heat exchange fluid encounters the fourth branching point 104. From the fourth shutoff valve 108, the first heat exchange fluid is directed toward the second coupling point 132. With the fifth and sixth shutoff valves 124, 128 each in the closed position, when the first heat exchange fluid encounters the second coupling point 132, the first heat exchange fluid is directed toward the sixth branching point 140. As stated above, the refrigerant loop 24 splits into two paths at the sixth branching point 140. The third expansion valve 144 is positioned immediately downstream of the sixth branching point 140 along the first path that extends from the sixth branching point 140. The fourth expansion valve 152 is positioned immediately downstream of the sixth branching point 140 along the second path that extends from the sixth branching point 140.

Figure 10:
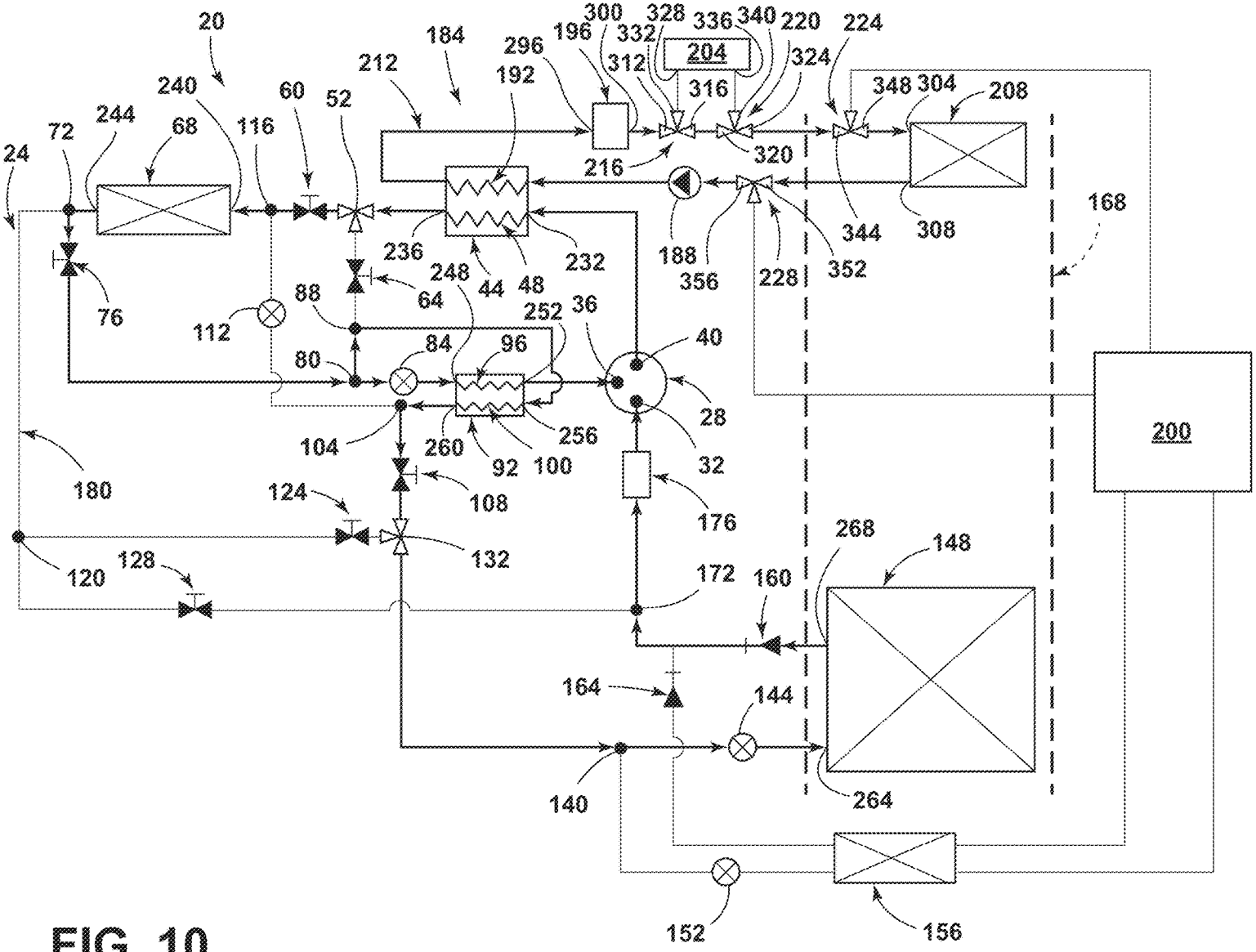
FIG. 10 is a schematic representation of the heat pump arrangement, illustrating a reheat mode of operation, according to one example.
Figure 11:
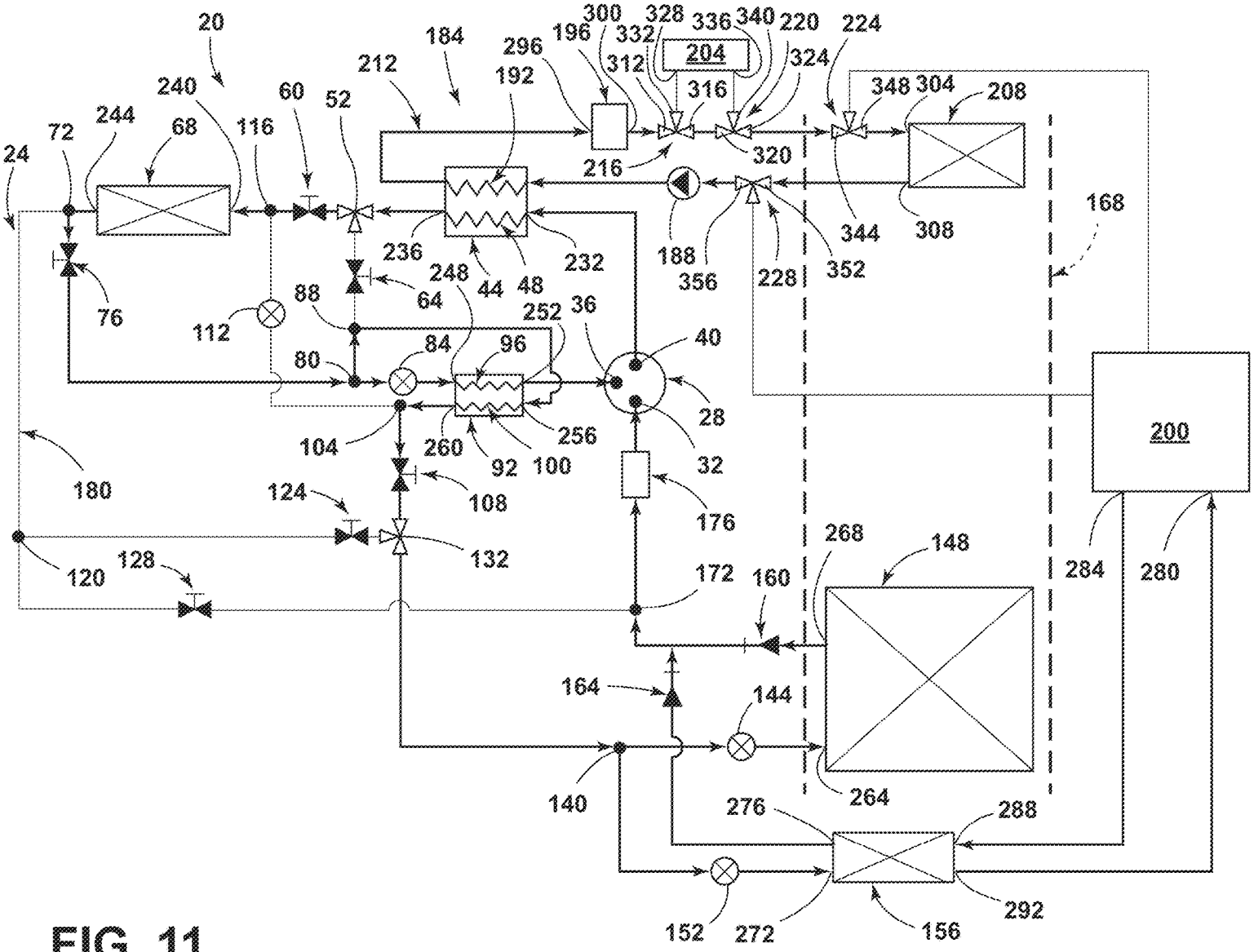
FIG. 11 is a schematic representation of the heat pump arrangement, illustrating a reheat and battery cooling mode of operation, according to one example.
Figure 12:
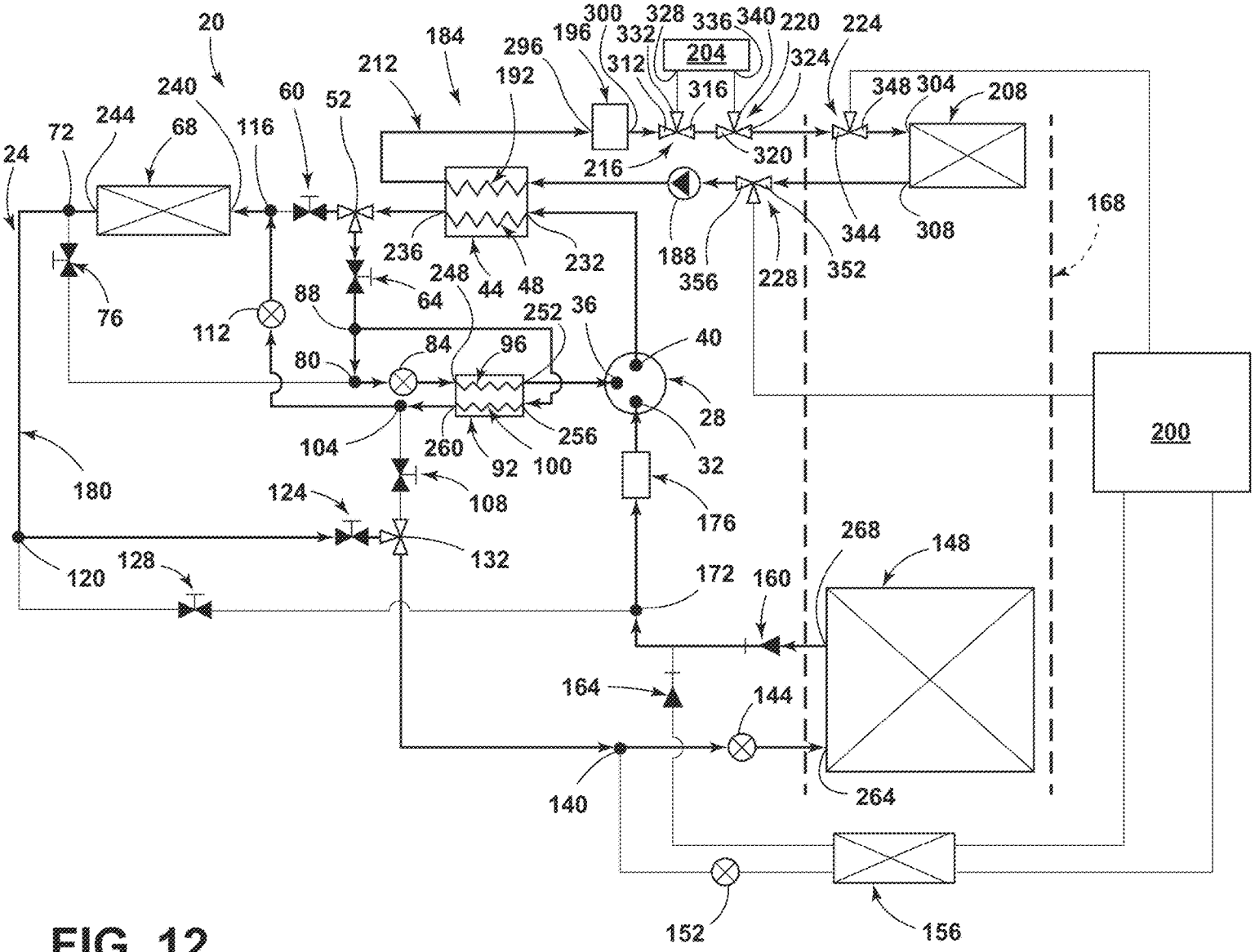
FIG. 12 is a schematic representation of the heat pump arrangement, illustrating a cabin dehumidification with serial evaporation mode of operation, according to one example.

With specific reference to FIGS. 10 and 11, from the sixth branching point 140, at least a portion of the first heat exchange fluid is directed to the third expansion valve 144. In the mode of operation depicted in FIG. 10, the fourth expansion valve 152 acts as a shutoff valve that is in a closed position in these modes of operation. Accordingly, in the mode of operation depicted in FIG. 10, an entirety of the first heat exchange fluid that encounters the sixth branching point 140 is directed toward the third expansion valve 144. The first heat exchange fluid decreases in pressure and temperature as a result of interaction with the third expansion valve 144. From the third expansion valve 144, the first heat exchange fluid is directed to the inlet 264 of the third heat exchanger 148. The third heat exchanger 148 performs as already described. The first heat exchange fluid exits the third heat exchanger 148 by way of the outlet 268 thereof. After exiting the third heat exchanger 148 by way of the outlet 268, the first heat exchange fluid flows through the first check valve 160. From the first check valve 160, the first heat exchange fluid is directed toward the accumulator 176 by the refrigerant network of conduits 180. In the mode of operation depicted in FIG. 10, the second check valve 164 prevents backflow toward the fourth heat exchanger 156. Accordingly, the fourth heat exchanger 156 is prevented from becoming a storage vessel for the first heat exchange fluid when the fourth heat exchanger 156 is not employed in a given mode of operation. From the first check valve 160, the first heat exchange fluid flows toward the accumulator 176. On the way to the accumulator 176, the first heat exchange fluid flows through the third coupling point 172. The accumulator 176 receives the first heat exchange fluid and provides a gaseous component of the first heat exchange fluid to the low-pressure inlet 32 of the compressor 28.

Figure 17:
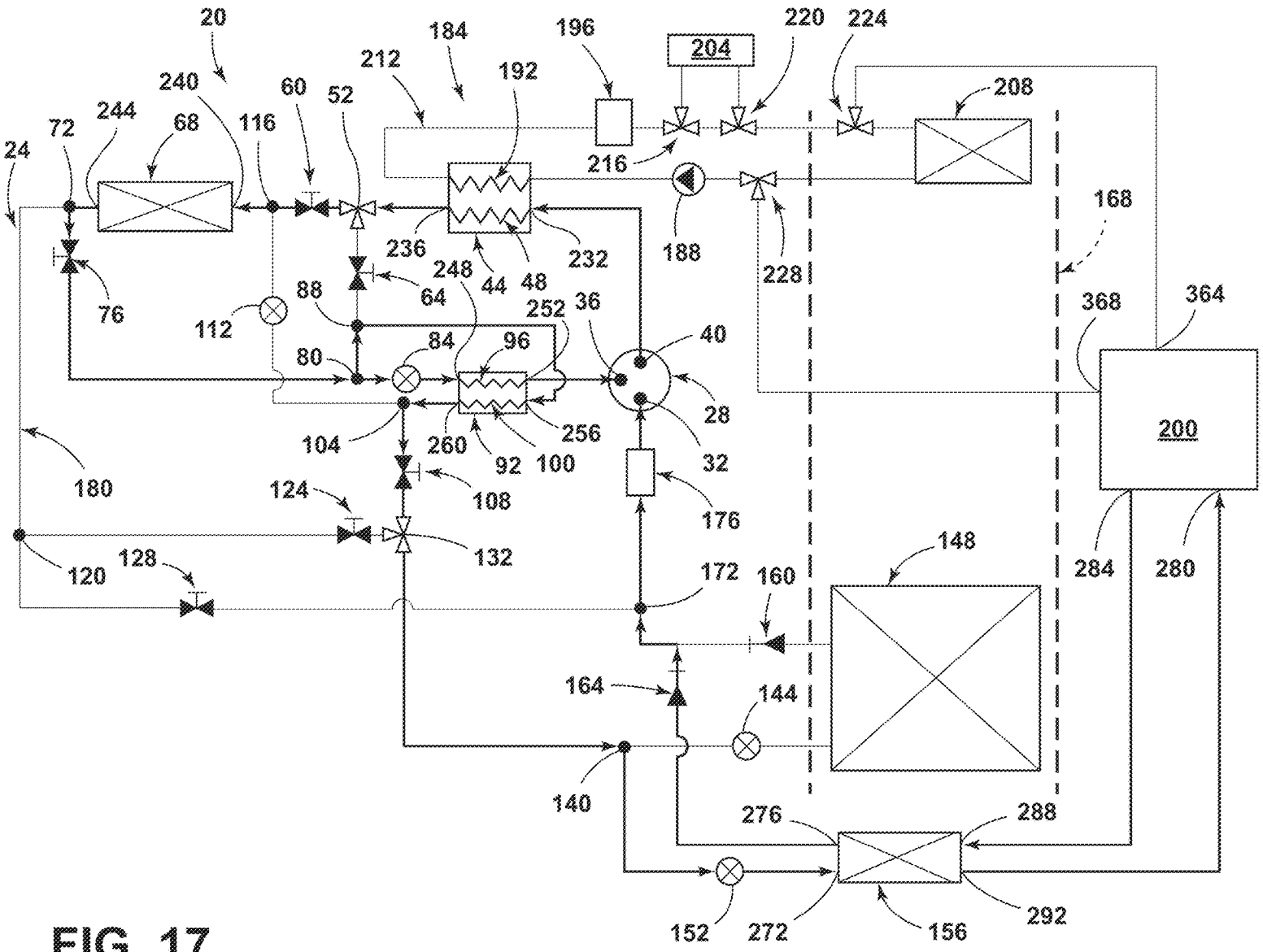
FIG. 17 is a schematic representation of the heat pump arrangement, illustrating a de-ice and battery cooling mode of operation.
Figure 18:
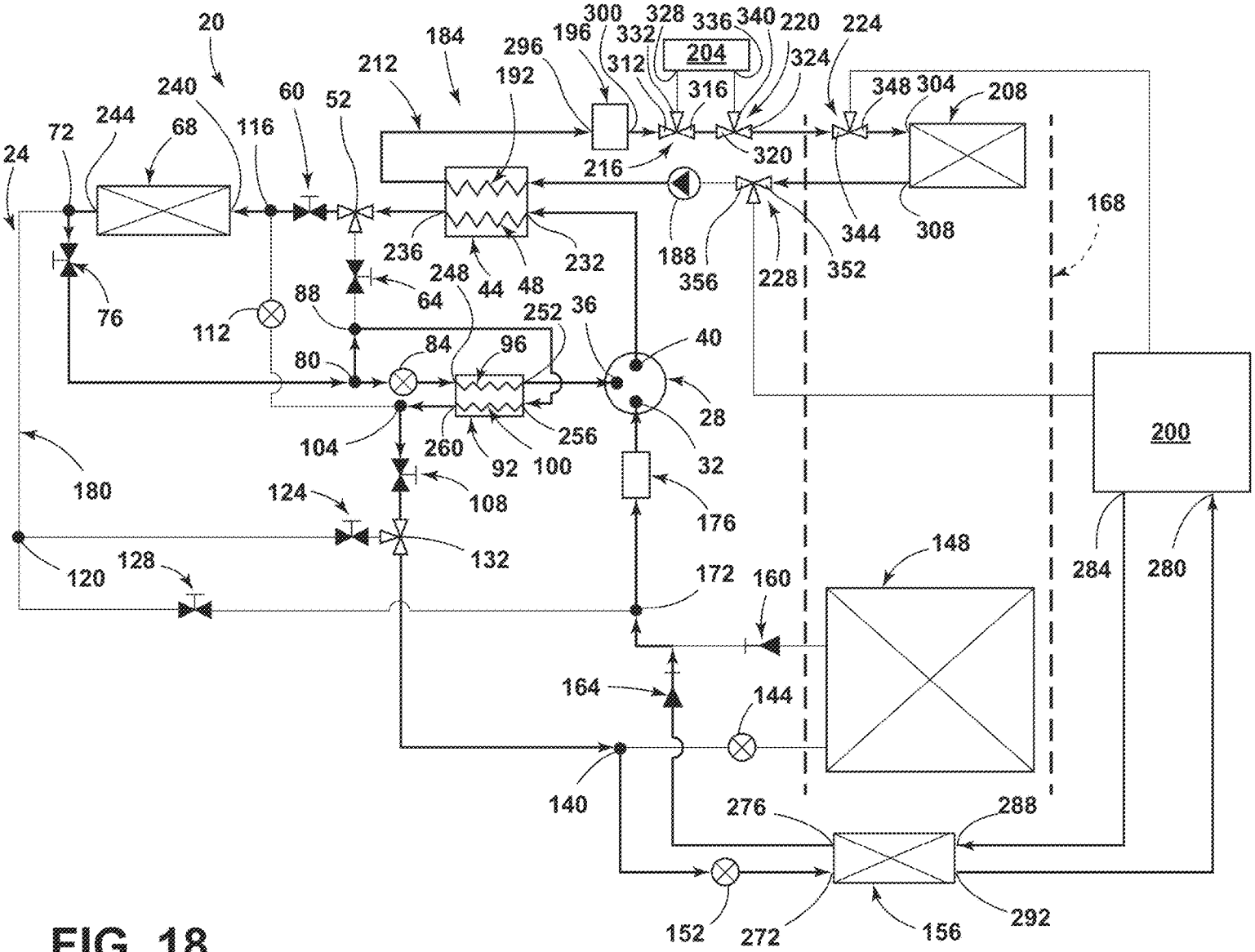
FIG. 18 is a schematic representation of the heat pump arrangement, illustrating a cabin heating, de-ice, and battery cooling mode of operation.

Referring particularly to FIGS. 11, 17, and 18, from the sixth branching point 140, at least a portion of the first heat exchange fluid is directed to the fourth expansion valve 152. In the mode of operation depicted in FIG. 11, the first heat exchange fluid that encounters the sixth branching point 140 is split into a first portion that is directed along a first path toward the third heat exchanger 148 in the manner described above and a second portion that is directed along a second path toward the fourth heat exchanger 156. The second portion of the first heat exchange fluid encounters the fourth expansion valve 152 on the way to the fourth heat exchanger 156. In the modes of operation depicted in FIGS. 17 and 18, an entirety of the first heat exchange fluid that encounters the sixth branching point 140 is directed toward the fourth expansion valve 152. The first heat exchange fluid decreases in pressure and temperature as a result of interaction with the fourth expansion valve 152. From the fourth expansion valve 152, the first heat exchange fluid is directed to the first inlet 272 of the fourth heat exchanger 156. The decreased temperature and pressure of the first heat exchange fluid that was provided by the fourth expansion valve 152 may be employed to provide cooling to the second, or third, heat exchange fluid that is also flowing through the fourth heat exchanger 156, as discussed above. Therefore, the first heat exchange fluid that exits the fourth heat exchanger 156 by way of the first outlet 276 thereof may have an increased pressure, temperature, and/or vapor percentage when compared to the first heat exchange fluid that entered the fourth heat exchanger 156 at the first inlet 272.

Referring again to FIGS. 11, 17, and 18, from the first outlet 276 of the fourth heat exchanger 156, the first heat exchange fluid is directed to the second check valve 164 by the refrigerant network of conduits 180. The first heat exchange fluid flows through the second check valve 164 and is directed toward the accumulator 176. In the mode of operation depicted in FIG. 11, after exiting the second check valve 164, the second portion of the first heat exchange fluid is rejoined, or recombined, with the first portion of the first heat exchange fluid prior to reaching the accumulator 176. In the modes of operation depicted in FIGS. 17 and 18, the first check valve 160 prevents back flow toward the third heat exchanger 148. Accordingly, the third heat exchanger 148 is prevented from becoming a storage vessel for the first heat exchange fluid when the third heat exchanger 148 is not employed in a given mode of operation. On the way to the accumulator 176, the first heat exchange fluid passes through the third coupling point 172. The accumulator 176 receives the first heat exchange fluid and performs as described above.

Referring further to FIGS. 11, 17, and 18, the second, or third, heat exchange fluid flows between the fourth heat exchanger 156 and the first heat-producing component 200. More specifically, the first inlet 280 of the first heat-producing component 200 receives the second, or third, heat exchange fluid from the fourth heat exchanger 156. The second, or third, heat exchange fluid received at the first inlet 280 of the first heat-producing component 200 can decrease a temperature of the first heat-producing component 200. Therefore, the second, or third, heat exchange fluid that exits the first heat-producing component 200 by way of the first outlet 284 thereof may have a greater pressure, temperature, and/or vapor percentage than the second, or third, heat exchange fluid that was received at the first inlet 280. The first heat-producing component 200 is further plumbed to the coolant loop 184, as will be discussed in further detail herein.

Referring still further to FIGS. 11, 17, and 18, from the first outlet 284 of the first heat-producing component 200, the second, or third, heat exchange fluid is directed toward the second inlet 288 of the fourth heat exchanger 156. The first heat exchange fluid received at the first inlet 272 and the second, or third, heat exchange fluid received at the second inlet 288 can thermally interact with one another within the fourth heat exchanger 156. The second, or third, heat exchange fluid that is received at the second inlet 288 exits the fourth heat exchanger 156 by way of the second outlet 292 thereof. From the second outlet 292 of the fourth heat exchanger 156, the second, or third, heat exchange fluid is directed back toward the first inlet 280 of the first heat-producing component 200. In each of these modes of operation, the first heat-producing component 200 may be cooled as a result of the thermal exchange between the first heat exchange fluid and the second, or third, heat exchange fluid.

Referring to FIGS. 12-15, a cabin dehumidification with serial evaporation mode of operation (FIG. 12), a cabin dehumidification with parallel evaporation mode of operation (FIG. 13), a cabin heating and battery cooling with serial evaporation mode of operation (FIG. 14), and a cabin heating and battery cooling with parallel evaporation mode of operation (FIG. 15) are each depicted in exemplary form. In each of these modes of operation, the first shutoff valve 60 is in the closed position and the second shutoff valve 64 is in the open position. Accordingly, from the first branching point 52, the first heat exchange fluid is directed toward the second shutoff valve 64. After flowing through the second shutoff valve 64, the first heat exchange fluid is directed to the third branching point 88. At the third branching point 88, the refrigerant loop 24 splits into the first path and the second path. The intersection point 80 is positioned immediately downstream of the third branching point 88 along the first path and receives a first portion of the first heat exchange fluid that encounters the third branching point 88. The second region 100 of the vapor generator 92 is positioned immediately downstream of the third branching point 88 along the second path and receives a second portion of the first heat exchange fluid that encounters the third branching point 88.

Referring again to FIGS. 12-15, in these modes of operation, the intersection point 80 behaves as a coupling point. The first portion of the first heat exchange fluid is received at the intersection point 80 and directed toward the first expansion valve 84. As a result of interaction with the first expansion valve 84, the first portion of the first heat exchange fluid decreases in pressure and temperature. From the first expansion valve 84, the first portion of the first heat exchange fluid is directed toward the inlet 248 of the first region 96 of the vapor generator 92. The first portion of the first heat exchange fluid flows through the first region 96 of the vapor generator 92 and exits the first region 96 by way of the outlet 252 thereof. While within the first region 96 of the vapor generator 92, the first portion of the first heat exchange fluid thermally interacts with the second portion of the first heat exchange fluid in the manner already described. The first heat exchange fluid that exits the first region 96 by way of the outlet 252 is directed toward the mid-pressure inlet 36 of the compressor 28. The first heat exchange fluid from the first region 96 of the vapor generator 92 is injected into the compressor 28.

Referring further to FIGS. 12-15, the second portion of the first heat exchange fluid is received at the inlet 256 of the second region 100 of the vapor generator 92. The second portion of the first heat exchange fluid passes through the second region 100 and thermally interacts with the first portion passing through the first region 96 in the manner already described. The second portion of the first heat exchange fluid exits the second region 100 by way of the outlet 260 thereof and is directed toward the fourth branching point 104. In the mode of operation depicted in FIG. 12, the fourth shutoff valve 108 is in the closed position. Accordingly, in the mode of operation depicted in FIG. 12, an entirety of the first heat exchange fluid that encounters the fourth branching point 104 is directed toward the second expansion valve 112. In the modes of operation depicted in FIGS. 13-15, the fourth shutoff valve 108 is in the open position. Accordingly, in the modes of operation depicted in FIGS. 13-15, a first portion of the first heat exchange fluid that encounters the fourth branching point 104 is directed along the first path that leads toward the fourth shutoff valve 108 and a second portion of the first heat exchange fluid that encounters the fourth branching point 104 is directed along the second path that leads toward the second expansion valve 112. The first portion of the first heat exchange fluid that encounters the fourth branching point 104 is directed toward the second coupling point 132. On the way to the second coupling point 132, the first portion of the first heat exchange fluid passes through the fourth shutoff valve 108 in the modes of operation depicted in FIGS. 13-15.

Referring still further to FIGS. 12-15, at least a portion of the first heat exchange fluid that encounters the fourth branching point 104 is received by the second expansion valve 112. As a result of interaction with the second expansion valve 112, the first heat exchange fluid decreases in pressure and temperature. From the second expansion valve 112, the first heat exchange fluid is directed toward the first coupling point 116. In each of these modes of operation, the first shutoff valve 60 is in the closed position. Accordingly, the first heat exchange fluid received at the first coupling point 116 is directed toward the inlet 240 of the second heat exchanger 68. The second heat exchanger 68 performs as already described. The first heat exchange fluid exits the second heat exchanger 68 by way of the outlet 244 thereof.

Referring again to FIGS. 12-15, the third shutoff valve 76 is in the closed position in each of these modes of operation. Accordingly, from the second branching point 72, the first heat exchange fluid is directed to the fifth shutoff valve 124 or the sixth shutoff valve 128 depending on the given mode of operation. In the modes of operation depicted in FIGS. 12 and 14, the fifth shutoff valve 124 is in the open position and the sixth shutoff valve 128 is in the closed position. Accordingly, from the second branching point 72, the first heat exchange fluid is directed toward the fifth shutoff valve 124 in the modes of operation depicted in FIGS. 12 and 14. After passing through the fifth shutoff valve 124, the first heat exchange fluid encounters the second coupling point 132. In the mode of operation depicted in FIG. 14, the first portion and the second portion of the first heat exchange fluid that encountered the fourth branching point 104 are rejoined, or recombined at the second coupling point 132. From the second coupling point 132, the first heat exchange fluid is directed toward the sixth branching point 140.

Figure 13:
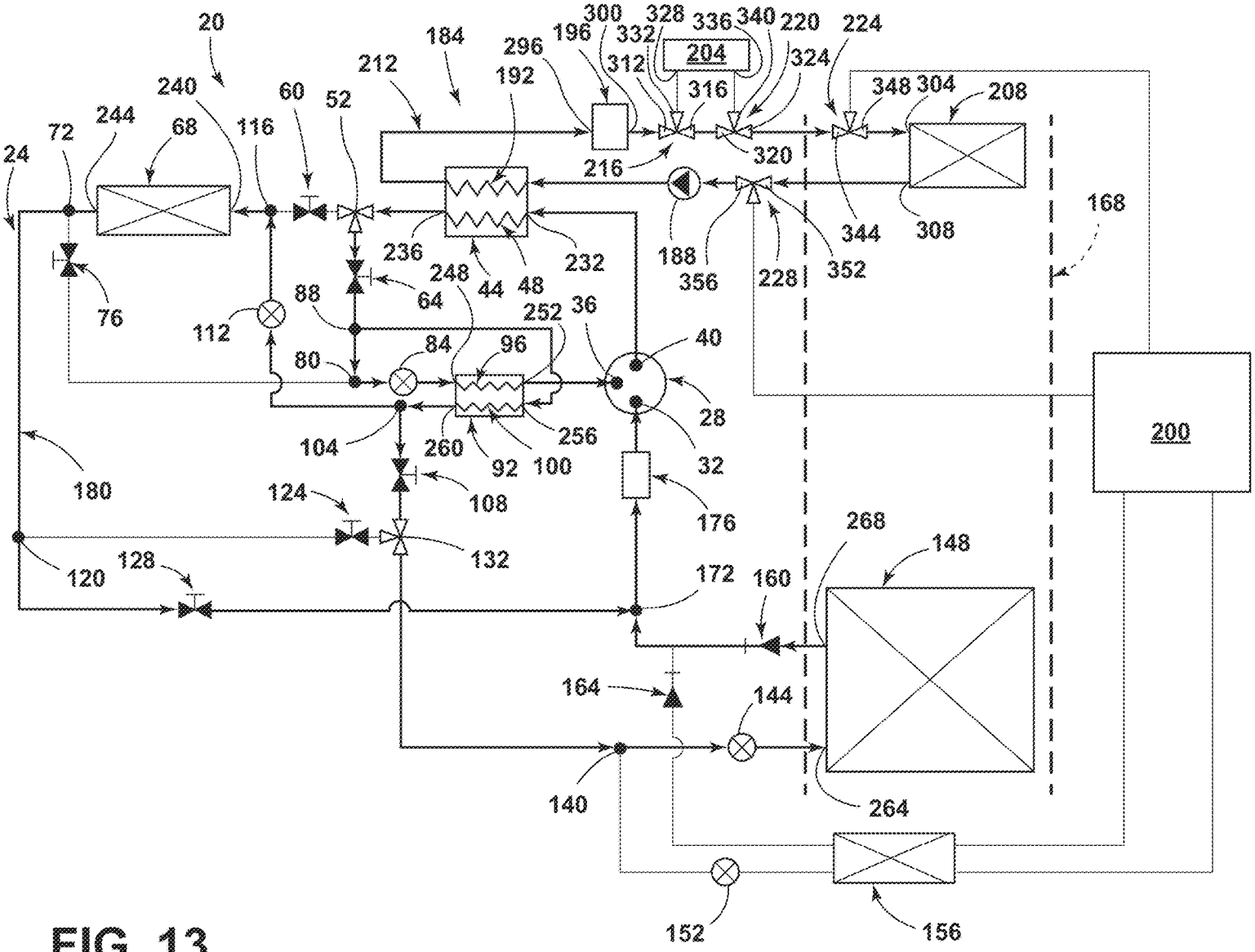
FIG. 13 is a schematic representation of a heat pump arrangement, illustrating a cabin dehumidification with parallel evaporation mode of operation, according to one example.
Figure 15:
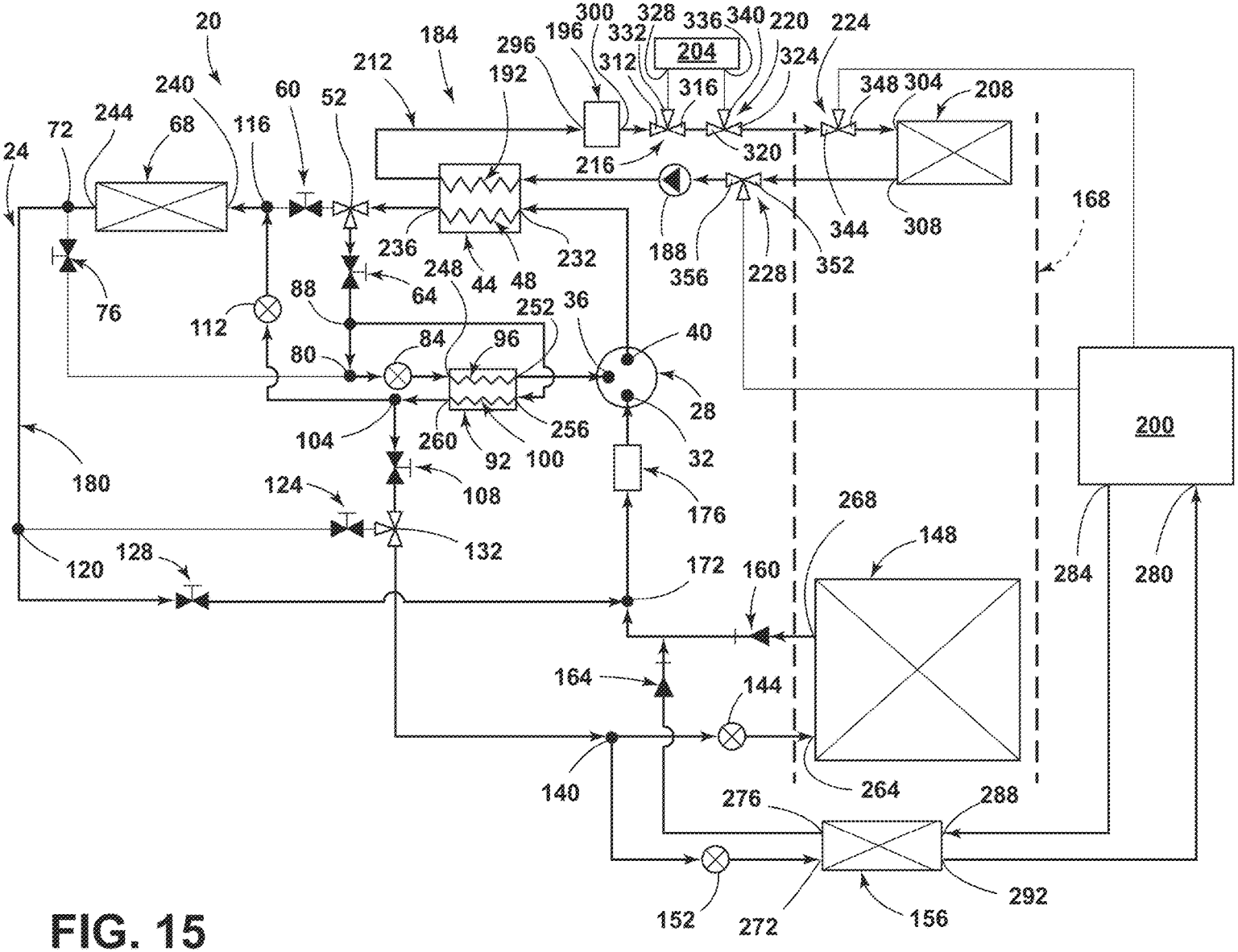
FIG. 15 is a schematic representation of the heat pump arrangement, illustrating a cabin heating and battery cooling with parallel evaporation mode of operation, according to one example.

With specific reference to FIGS. 13 and 15, the fifth shutoff valve 124 is in the closed position and the sixth shutoff valve 128 is in the open position. Accordingly, the second portion of the first heat exchange fluid that encountered the fourth branching point 104 is directed toward the sixth shutoff valve 128 from the second branching point 72. After passing through the sixth shutoff valve 128, the first heat exchange fluid is directed toward the third coupling point 172. At the third coupling point 172, the second portion of the first heat exchange fluid that encountered the fourth branching point 104 is rejoined, or recombined, with the first heat exchange fluid that flows from the first check valve 160 and/or the second check valve 164.

Referring further to FIGS. 12-15, as stated above, the refrigerant loop 24 splits into two paths at the sixth branching point 140. The third expansion valve 144 is positioned immediately downstream of the sixth branching point 140 along the first path that extends from the sixth branching point 140. The fourth expansion valve 152 is positioned immediately downstream of the sixth branching point 140 along the second path that extends from the sixth branching point 140. From the sixth branching point 140, at least a portion of the first heat exchange fluid is directed to the third expansion valve 144. In the modes of operation depicted in FIGS. 12 and 13, the fourth expansion valve 152 acts as a shutoff valve that is in a closed position. Accordingly, in the modes of operation depicted in FIGS. 12 and 13, an entirety of the first heat exchange fluid that encounters the sixth branching point 140 is directed toward the third expansion valve 144. The first heat exchange fluid decreases in pressure and temperature as a result of interaction with the third expansion valve 144. From the third expansion valve 144, the first heat exchange fluid is directed to the inlet 264 of the third heat exchanger 148. The third heat exchanger 148 performs as already described. The first heat exchange fluid exits the third heat exchanger 148 by way of the outlet 268 thereof. After exiting the third heat exchanger 148 by way of the outlet 268, the first heat exchange fluid flows through the first check valve 160.

Referring still further to FIGS. 12-15, from the first check valve 160, the first heat exchange fluid is directed toward the accumulator 176 by the refrigerant network of conduits 180. In the modes of operation depicted in FIGS. 12 and 13, the second check valve 164 prevents backflow toward the fourth heat exchanger 156. Accordingly, the fourth heat exchanger 156 is prevented from becoming a storage vessel for the first heat exchange fluid when the fourth heat exchanger 156 is not employed in a given mode of operation. From the first check valve 160, the first heat exchange fluid flows toward the accumulator 176. On the way to the accumulator 176, the first heat exchange fluid flows through the third coupling point 172. The accumulator 176 receives the first heat exchange fluid and provides a gaseous component of the first heat exchange fluid to the low-pressure inlet 32 of the compressor 28.

Figure 14:
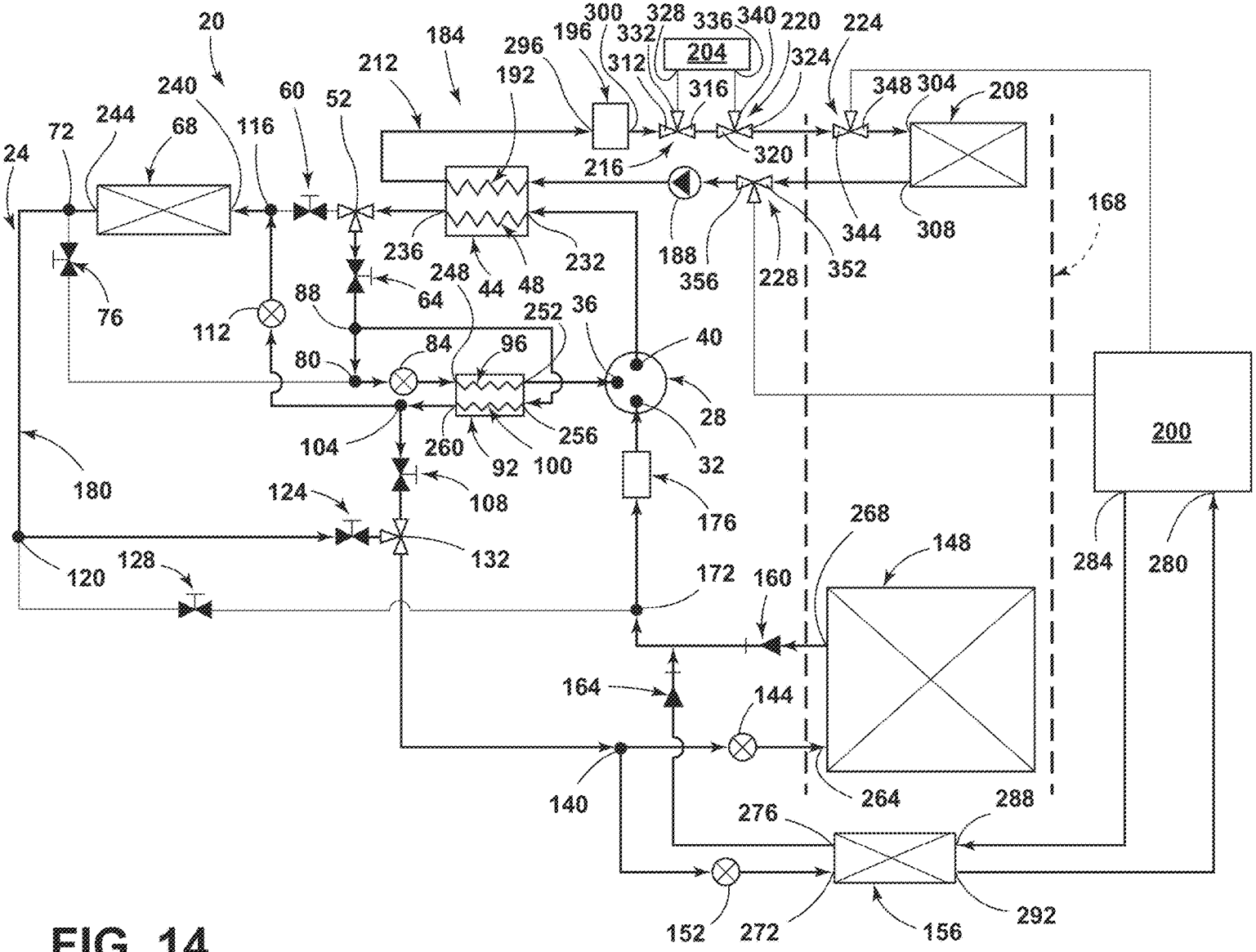
FIG. 14 is a schematic representation of the heat pump arrangement, illustrating a cabin heating and battery cooling with serial evaporation mode of operation, according to one example.

With specific reference to FIGS. 14 and 15, from the sixth branching point 140, a first portion of the first heat exchange fluid that encounters the sixth branching point 140 is directed toward the third expansion valve 144 in the manner described above. A second portion of the first heat exchange fluid that encounters the sixth branching point 140 is directed toward the fourth expansion valve 152. The first heat exchange fluid decreases in pressure and temperature as a result of interaction with the fourth expansion valve 152. From the fourth expansion valve 152, the first heat exchange fluid is directed to the first inlet 272 of the fourth heat exchanger 156. The decreased temperature and pressure of the first heat exchange fluid that was provided by the fourth expansion valve 152 may be employed to provide cooling to the second, or third, heat exchange fluid that is also flowing through the fourth heat exchanger 156. Therefore, the first heat exchange fluid that exits the fourth heat exchanger 156 by way of a first outlet 276 thereof may have an increased pressure, temperature, and/or vapor percentage when compared to the first heat exchange fluid that entered the fourth heat exchanger 156 at the first inlet 272.

Referring again to FIGS. 14 and 15, from the first outlet 276 of the fourth heat exchanger 156, the first heat exchange fluid is directed to the second check valve 164 by the refrigerant network of conduits 180. The first heat exchange fluid flows through the second check valve 164 and is directed toward the accumulator 176. After exiting the second check valve 164, the second portion of the first heat exchange fluid that encountered the sixth branching point 140 is rejoined, or recombined, with the first portion of the first heat exchange fluid that encountered the sixth branching point 140 prior to reaching the accumulator 176. On the way to the accumulator 176, the first heat exchange fluid passes through the third coupling point 172. The accumulator 176 receives the first heat exchange fluid and performs as described above, thereby completing the traversal of the refrigerant loop 24.

Referring further to FIGS. 14 and 15, the second, or third, heat exchange fluid flows between the fourth heat exchanger 156 and the first heat-producing component 200. More specifically, the first inlet 280 of the first heat-producing component 200 receives the second, or third, heat exchange fluid from the fourth heat exchanger 156. The second, or third, heat exchange fluid received at the first inlet 280 of the first heat-producing component 200 can decrease a temperature of the first heat-producing component 200. More specifically, the decreased temperature, pressure, and/or vapor percentage provided to the first heat exchange fluid flowing through the fourth heat exchanger 156 as a result of interaction with the fourth expansion valve 152 can be employed for thermal exchange with the second, or third, heat exchange fluid. Accordingly, the second, or third, heat exchange fluid that exits the fourth heat exchanger 156 may have a decreased temperature, pressure, and/or vapor percentage when compared to the second, or third, heat exchange fluid that entered the fourth heat exchanger 156. Therefore, the second, or third, heat exchange fluid that exits the first heat-producing component 200 by way of the first outlet 284 thereof may have a greater pressure, temperature, and/or vapor percentage than the second, or third, heat exchange fluid that was received at the first inlet 280. The first heat-producing component 200 is further plumbed to the coolant loop 184, as will be discussed in further detail herein.

Referring still further to FIGS. 14 and 15, from the first outlet 284 of the first heat-producing component 200, the second, or third, heat exchange fluid is directed toward the second inlet 288 of the fourth heat exchanger 156. The first heat exchange fluid received at the first inlet 272 and the second, or third, heat exchange fluid received at the second inlet 288 can thermally interact with one another within the fourth heat exchanger 156. The second, or third, heat exchange fluid that is received at the second inlet 288 exits the fourth heat exchanger 156 by way of the second outlet 292 thereof. From the second outlet 292 of the fourth heat exchanger 156, the second, or third, heat exchange fluid is directed back toward the first inlet 280 of the first heat-producing component 200. In each of these modes of operation, the first heat-producing component 200 may be cooled as a result of the thermal exchange between the first heat exchange fluid and the second, or third, heat exchange fluid.

Figure 16:
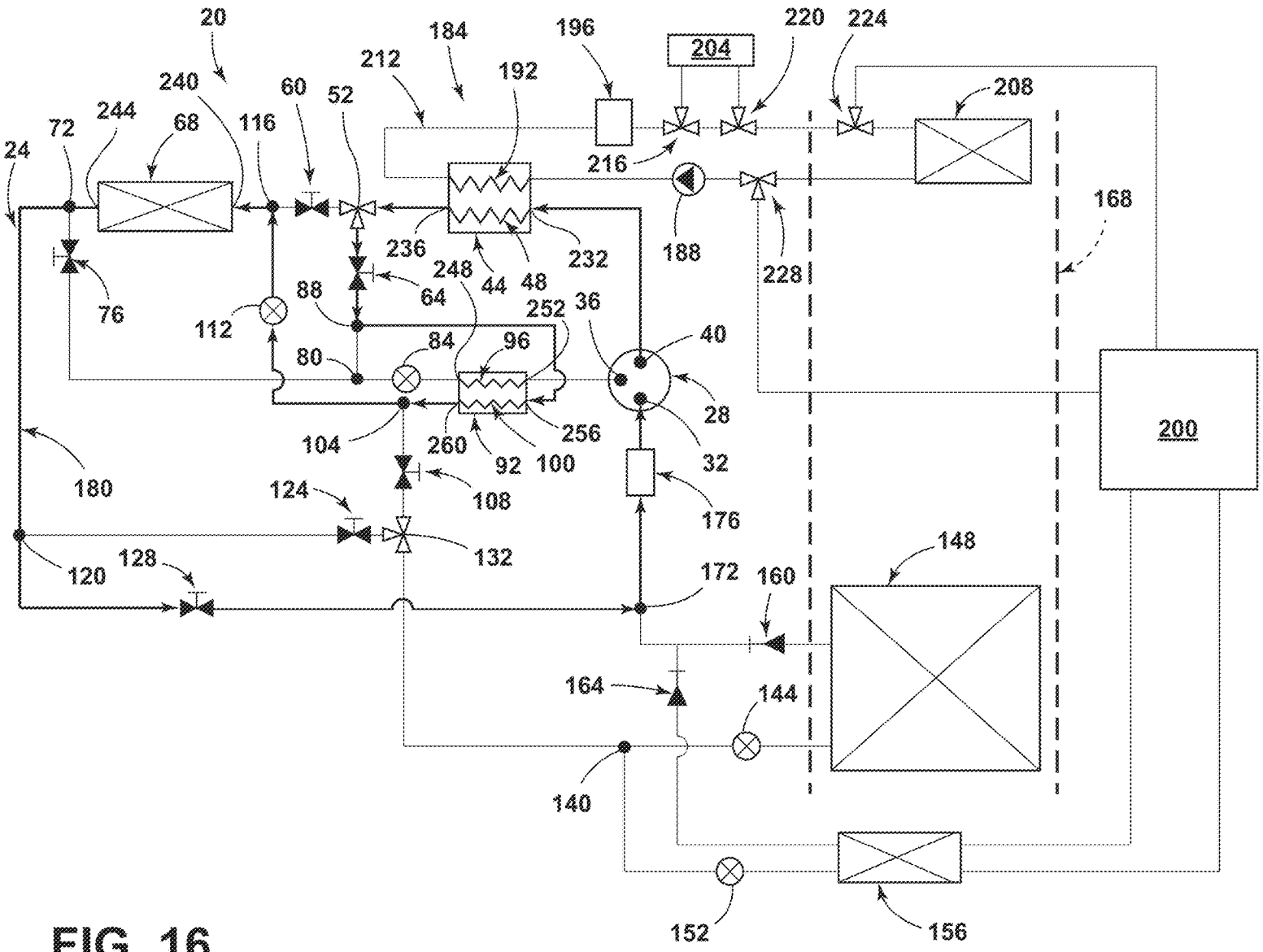
FIG. 16 is a schematic representation of the heat pump arrangement, illustrating a de-ice mode of operation.

Referring to FIG. 16, a de-ice mode of operation is depicted in exemplary form. The first shutoff valve 60 is in the closed position and the second shutoff valve 64 is in the open position. Accordingly, the first heat exchange fluid received at the first branching point 52 is directed toward the second shutoff valve 64. In this mode of operation, the third shutoff valve 76 is in the closed position and the first expansion valve 84 operates as a shutoff valve that is in a closed position. Accordingly, after flowing through the second shutoff valve 64, an entirety of the first heat exchange fluid that encounters the third branching point 88 is directed toward the inlet 256 of the second region 100 of the vapor generator 92. Therefore, the vapor generator 92 may be referred to as being "off" or in a "disengaged state" as the vapor generator 92 does not provide gaseous components of the first heat exchange fluid to the mid-pressure inlet 36 of the compressor 28. The first heat exchange fluid flows through the second region 100 of the vapor generator 92 and exits by way of the outlet 260 thereof.

Referring again to FIG. 16, the fourth shutoff valve 108 is in the closed position. Accordingly, an entirety of the first heat exchange fluid that encounters the fourth branching point 104 is directed toward the second expansion valve 112. As a result of interaction with the second expansion valve 112, the first heat exchange fluid decreases in pressure and temperature. From the second expansion valve 112, the first heat exchange fluid is directed toward the first coupling point 116. With the first shutoff valve 60 is in the closed position, the first heat exchange fluid received at the first coupling point 116 is directed toward the inlet 240 of the second heat exchanger 68. The second heat exchanger 68 performs as already described. The first heat exchange fluid exits the second heat exchanger 68 by way of the outlet 244 thereof. The third shutoff valve 76 and the fifth shutoff valve 124 are each in the closed position. Accordingly, the first heat exchange fluid received at the second branching point 72 is directed toward the sixth shutoff valve 128. From the sixth shutoff valve 128, the first heat exchange fluid is directed toward the third coupling point 172. The accumulator 176 receives the first heat exchange fluid from the third coupling point 172 and performs as already described.

Referring now to FIGS. 5-15 and 18, various modes of operation of the heat pump 20 that employ the coolant loop 184 are depicted. The pump 188 is activated in these modes of operation such that the second heat exchange fluid is circulated through the components of the coolant loop 184. The second heat exchange fluid is driven from the pump 188 toward the first heat exchanger 44. Accordingly, the second heat exchange fluid thermally interacts with the first heat exchange fluid by way of the first heat exchanger 44. More specifically, the second heat exchange fluid is circulated through the second region 192 of the first heat exchanger 44 while the first heat exchange fluid is circulated through the first region 48 of the first heat exchanger 44. In various examples, the second heat exchange fluid may extract heat from the first heat exchange fluid at the first heat exchanger 44. From the first heat exchanger 44, the second heat exchange fluid is directed to an inlet 296 of the reservoir 196 by the coolant network of conduits 212. The reservoir 196 can accumulate the second heat exchange fluid. An outlet 300 of the reservoir 196 is plumbed to an inlet 304 of the fifth heat exchanger 208 by the coolant network of conduits 212. In various examples, additional components can be included with the coolant loop 184 and plumbed between the outlet 300 of the reservoir 196 and the inlet 304 of the fifth heat exchanger 208, as will be discussed in further detail herein.

Referring again to FIGS. 5-15 and 18, an outlet 308 of the fifth heat exchanger 208 is plumbed to the pump 188. Accordingly, as the pump 188 is operated, the second heat exchange fluid may be pulled from the reservoir 196 and into the inlet 304 of the fifth heat exchanger 208 in a siphon-like manner. Said another way, operation of the pump 188 may generate a positive pressure at the inlet 296 of the reservoir 196 and a negative pressure at the outlet 300 of the reservoir 196. Therefore, the pressure differential across the reservoir 196 can facilitate the introduction of the second heat exchange fluid into the inlet 304 of the fifth heat exchanger 208 in modes of operation that employ the fifth heat exchanger 208. A similar phenomenon to that described above can apply to the first heat-producing component 200 in modes of operation that employ the first heat-producing component 200. In some examples, additional components can be included with the coolant loop 184 and plumbed between the outlet 308 of the fifth heat exchanger 208 and the pump 188. The second heat exchange fluid can provide heat to a cabin of a vehicle as a result of the fluid communication between the fifth heat exchanger 208 and a heat exchange fluid that is flowing through the ductwork 168 (e.g., ambient air). In various examples, the fifth heat exchanger 208 may operate as a heater core. Alternatively, heat from the second heat exchange fluid may be directed to components that can benefit from such heat, such as batteries, electrical components, the first heat-producing component 200, and/or the second heat-producing component 204 during cold weather conditions in the environment within which the vehicle or the heat pump 20 currently occupies at a given time.

Referring further to FIGS. 5-15 and 18, from the outlet 300 of the reservoir 196, the second heat exchange fluid is directed to a first port 312 of the first three-way valve 216. In each of these modes of operation, the first three-way valve 216 is positioned such that the second heat exchange fluid received at the first port 312 is directed to exit the first three-way valve 216 by way of a second port 316 thereof. From the second port 316 of the first three-way valve 216, the second heat exchange fluid is directed toward a first port 320 of the second three-way valve 220. In each of these modes of operation, the second three-way valve 220 is positioned such that the second heat exchange fluid received at the first port 320 is directed to exit the second three-way valve 220 by way of a second port 324 thereof. The second heat-producing component 204 is plumbed to the first and second three-way valves 216, 220 such that the second heat-producing component 204 is in series with the reservoir 196, the fifth heat exchanger 208, and/or the first heat-producing component 200. More specifically, an inlet 328 of the second heat-producing component 204 is plumbed to a third port 332 of the first three-way valve 216 and an outlet 336 of the second heat-producing component 204 is plumbed to a third port 340 of the second three-way valve 220.

Referring still further to FIGS. 5-15 and 18, when the first three-way valve 216 is positioned to utilize the second heat-producing component 204 in a given mode of operation, the second heat exchange fluid received at the first port 312 is directed to exit the first three-way valve 216 by way of the third port 332 thereof. From the third port 332 of the first three-way valve 216, the second heat exchange fluid is directed to the inlet 328 of the second heat-producing component 204. The second heat-producing component 204 can be an engine, electronics, battery, battery pack, one or more heating elements, brakes, or the like. After interacting with the second heat-producing component 204, the second heat exchange fluid exits the second heat-producing component 204 by way of the outlet 336 thereof. As a result of interaction with the second heat-producing component 204, the second heat exchange fluid that exits by way of the outlet 336 may have a greater pressure and/or a greater temperature than the second heat exchange fluid that entered by way of the inlet 328. From the outlet 336 of the second heat-producing component 204, the second heat exchange fluid is directed to the third port 340 of the second three-way valve 220. Based upon a positioning of the second three-way valve 220 in such an example, the second heat exchange fluid received at the third port 340 is directed to exit the second three-way valve 220 by way of the second port 324 thereof.

Referring yet again to FIGS. 5-15 and 18, from the second port 324 of the second three-way valve 220, the second heat exchange fluid is directed to a first port 344 of the third three-way valve 224. In the modes of operation depicted in FIGS. 5, 7-15, and 18, the third three-way valve 224 is positioned such that at least a portion of the second heat exchange fluid received at the first port 344 is directed to exit the third three-way valve 224 by way of a second port 348 thereof. The second heat exchange fluid that exits the third three-way valve 224 by way of the second port 348 thereof is directed to the inlet 304 of the fifth heat exchanger 208. While in the fifth heat exchanger 208, the heat carried by the second heat exchange fluid can be employed in the manner outlined above. The second heat exchange fluid exits the fifth heat exchanger 208 by way of the outlet 308. From the outlet 308, the second heat exchange fluid is directed toward a first port 352 of the fourth three-way valve 228. The second heat exchange fluid received at the first port 352 is directed to exit the fourth three-way valve 228 by way of a second port 356 thereof. From the second port 356 of the fourth three-way valve 228, the second heat exchange fluid is directed to the pump 188.

Figure 6:
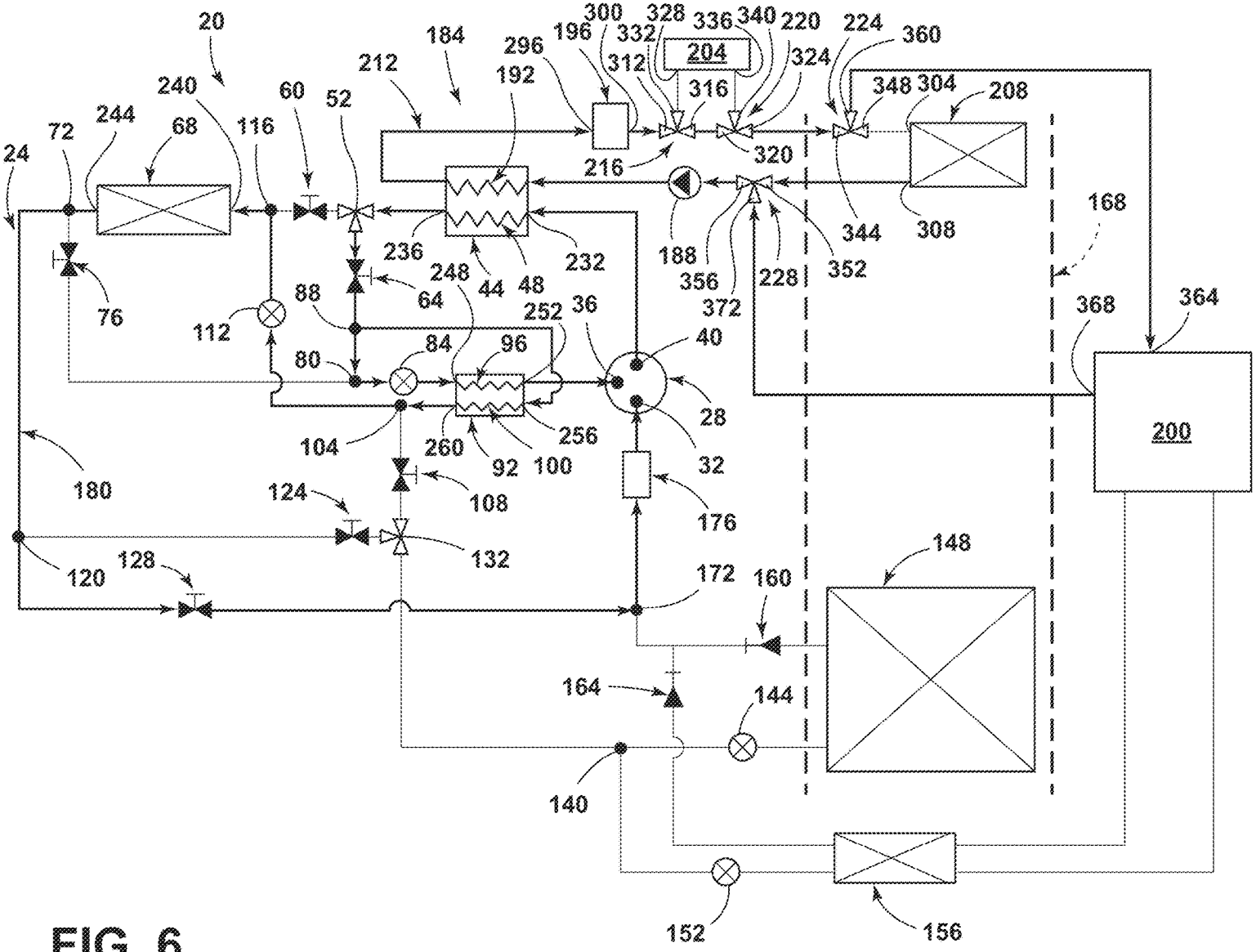
FIG. 6 is a schematic representation of the heat pump arrangement, illustrating a battery heating mode of operation, according to one example.
Figure 7:
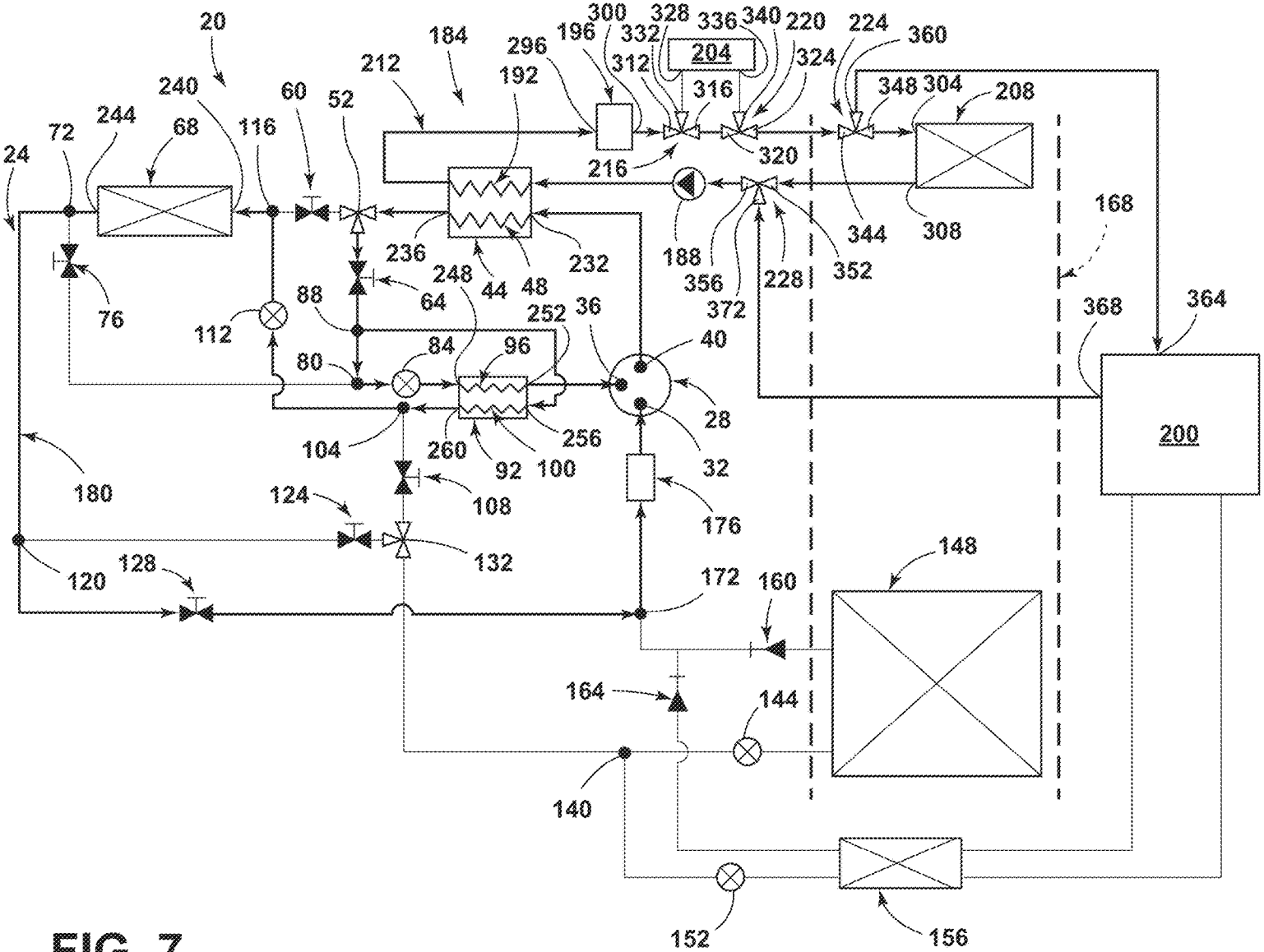
FIG. 7 is a schematic representation of the heat pump arrangement, illustrating a cabin and battery heating mode of operation, according to one example.

With particular reference to FIGS. 6 and 7, when the coolant loop 184 incorporates the first heat-producing component 200 in a given mode of operation, the third three-way valve 224 can be positioned such that at least a portion of the second heat exchange fluid received at the first port 344 is directed to exit the third three-way valve 224 by way of a third port 360 thereof. In the mode of operation depicted in FIG. 6, an entirety of the second heat exchange fluid received at the first port 344 of the third three-way valve 224 is directed to exit the third three-way valve 224 by way of the third port 360 thereof. In the mode of operation depicted in FIG. 7, the third three-way valve 224 is positioned such that the second heat exchange fluid received at the first port 344 is directed to exit the third three-way valve 224 by way of the second port 348, as well as the third port 360 thereof. Accordingly, the second heat exchange fluid can be split into a first portion and a second portion at the third three-way valve 224, with the first portion being directed toward the fifth heat exchanger 208 and the second portion being directed toward the first heat-producing component 200. The flow of the first portion of the second heat exchange fluid from the third three-way valve 224 through the fifth heat exchanger 208 has already been described.

Referring again to FIGS. 6 and 7, from the third port 360, the second portion of the second heat exchange fluid is directed to a second inlet 364 of the first heat-producing component 200. The second inlet 364 of the first heat-producing component 200 can be immediately downstream of the third port 360 of the third three-way valve 224. The second portion of the second heat exchange fluid received at the second inlet 364 may provide heat to the first heat-producing component 200 (e.g., during cold weather). The second portion of the second heat exchange fluid received at the second inlet 364 exits the first heat-producing component 200 by way of a second outlet 368 thereof. In some examples, the second portion of the second heat exchange fluid may decrease in temperature, pressure, and/or vapor percentage as a result of interaction with the first heat-producing component 200. Upon exiting the second outlet 368 of the first heat-producing component 200, the second portion of the second heat exchange fluid is directed to a third port 372 of the fourth three-way valve 228. In these modes of operation, the fourth three-way valve 228 is positioned such that the first portion of the second heat exchange fluid received at the first port 352 and the second portion of the second heat exchange fluid received at the third port 372 are recombined, or rejoined, and ultimately directed to exit the fourth three-way valve 228 by way of the second port 356 thereof. In the mode of operation depicted in FIG. 6, an entirety of the second heat exchange fluid follows the path outlined for the second portion of the second heat exchange fluid. Accordingly, in such a mode of operation, the second heat exchange fluid that exits the second outlet 368 of the first heat-producing component 200 is received at the third port 372 of the fourth three-way valve 228 and directed to exit the fourth three-way valve 228 by way of the second port 356 thereof. In the mode of operation depicted in FIG. 6, the fourth three-way valve 228 is positioned such that flow of the second heat exchange fluid from the first port 352 is prevented.

The present disclosure has discussed a variety of modes of operation for the heat pump 20. While a specific example of the heat pump 20 and specific examples of the modes of operation of the heat pump 20 have been discussed in detail, the present disclosure is not limited to the arrangement of the heat pump 20 discussed herein. Similarly, the present disclosure is not limited to the modes of operation discussed herein. Rather, the present disclosure provides exemplary discussion of the operation of the various components of the heat pump 20 that may inform additional modes of operation and/or arrangements that are not explicitly articulated herein.

Modifications of the disclosure will occur to those skilled in the art and to those who make or use the concepts disclosed herein. Therefore, it is understood that the embodiments shown in the drawings and described above are merely for illustrative purposes and not intended to limit the scope of the disclosure, which is defined by the following claims as interpreted according to the principles of patent law, including the doctrine of equivalents.

It will be understood by one having ordinary skill in the art that construction of the described concepts, and other components, is not limited to any specific material. Other exemplary embodiments of the concepts disclosed herein may be formed from a wide variety of materials, unless described otherwise herein.

For purposes of this disclosure, the term "coupled" (in all of its forms: couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature, or may be removable or releasable in nature, unless otherwise stated.

It is also important to note that the construction and arrangement of the elements of the disclosure, as shown in the exemplary embodiments, is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts, or elements shown as multiple parts may be integrally formed, the operation of the interfaces may be reversed or otherwise varied, the length or width of the structures and/or members or connector or other elements of the system may be varied, and the nature or numeral of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes, or steps within described processes, may be combined with other disclosed processes or steps to form structures within the scope of the present disclosure. The exemplary structures and processes disclosed herein are for illustrative purposes and are not to be construed as limiting.

It is also to be understood that variations and modifications can be made on the aforementioned structures and methods without departing from the concepts of the present disclosure, and further, it is to be understood that such concepts are intended to be covered by the following claims, unless these claims, by their language, expressly state otherwise.

What is claimed is:

1. A heat pump, comprising:

a refrigerant loop comprising:

a compressor having a low-pressure inlet, a mid-pressure inlet, and an outlet;

a first region of a first heat exchanger, wherein the first heat exchanger is positioned immediately downstream of the outlet of the compressor;

a first branching point positioned immediately downstream of the first region of the first heat exchanger, wherein the refrigerant loop splits into a first path and a second path at the first branching point;

a first shutoff valve positioned along the first path and immediately downstream of the first branching point;

a second shutoff valve positioned along the second path and immediately downstream of the first branching point;

a second heat exchanger positioned downstream of the first heat exchanger;

a vapor generator having a first region and a second region, wherein the second region is upstream of at least one of a third heat exchanger and a fourth heat exchanger;

a second branching point positioned immediately downstream of the second heat exchanger;

a third shutoff valve positioned immediately downstream of the second branching point;

an intersection point positioned immediately downstream of the third shutoff valve; and a first expansion valve positioned immediately downstream of the intersection point.

2. The heat pump of claim 1, wherein the intersection point operates as a branching point in a first mode of operation, and wherein the intersection point operates as a coupling point in a second mode of operation.

3. The heat pump of claim 1, wherein a fluid flows immediately from the intersection point to a third branching point in at least one mode of operation.

4. The heat pump of claim 3, wherein the fluid flows immediately from the second shutoff valve to the third branching point in at least a separate mode of operation.

5. The heat pump of claim 3, wherein the vapor generator has the first region and the second region, wherein the first region is positioned immediately downstream of the first expansion valve, and wherein the second region is positioned immediately downstream of the third branching point.

6. The heat pump of claim 4, wherein the fluid flows immediately from the third branching point to the intersection point in the separate mode of operation.

7. The heat pump of claim 5, wherein the vapor generator is positioned upstream of both the low-pressure inlet and the mid-pressure inlet, and wherein the vapor generator delivers at least a portion of a gaseous component of a first heat exchange fluid to the mid-pressure inlet of the compressor.

8. The heat pump of claim 5, wherein the refrigerant loop further comprises:

a fourth branching point positioned immediately downstream of the second region of the vapor generator.

9. The heat pump of claim 7, wherein the fluid flows from the vapor generator to the second heat exchanger in a first mode of operation, and wherein the fluid flows from the second heat exchanger to the vapor generator in a second mode of operation.

10. The heat pump of claim 8, wherein the refrigerant loop further comprises:

a fourth shutoff valve positioned immediately downstream of the fourth branching point.

11. The heat pump of claim 10, wherein the refrigerant loop further comprises:

a second expansion valve positioned immediately downstream of the fourth branching point, wherein the second expansion valve is upstream of the second heat exchanger.

12. The heat pump of claim 11, wherein the refrigerant loop further comprises:

a fifth branching point positioned immediately downstream of the second branching point;

a fifth shutoff valve positioned immediately downstream of the fifth branching point; and a sixth shutoff valve positioned immediately downstream of the fifth branching point.

13. A heat pump, comprising:

a refrigerant loop comprising:

a compressor having a low-pressure inlet, a mid-pressure inlet, and an outlet;

a first region of a first heat exchanger, wherein the first heat exchanger is positioned immediately downstream of the outlet of the compressor;

a first branching point positioned immediately downstream of the first region of the first heat exchanger, wherein the refrigerant loop splits into a first path and a second path at the first branching point;

a first shutoff valve positioned along the first path and immediately downstream of the first branching point;

a second shutoff valve positioned along the second path and immediately downstream of the first branching point;

a second heat exchanger downstream of the first heat exchanger;

a second branching point positioned immediately downstream of the second heat exchanger;

a third shutoff valve positioned immediately downstream of the second branching point;

an intersection point positioned immediately downstream of the third shutoff valve;

a first expansion valve positioned immediately downstream of the intersection point;

a third branching point, wherein a fluid flows immediately from the intersection point to the third branching point in at least one mode of operation; and a vapor generator having a first region and a second region, wherein the first region is positioned immediately downstream of the first expansion valve, and wherein the second region is positioned immediately downstream of the third branching point, and wherein the second region is positioned immediately upstream of a fourth branching point, the fourth branching point being immediately upstream of a second expansion valve, and wherein the second expansion valve is immediately upstream of a first coupling point.

14. The heat pump of claim 13, wherein the intersection point operates as a branching point in a first mode of operation, and wherein the intersection point operates as a second coupling point in a second mode of operation.

15. The heat pump of claim 13, wherein the fluid flows immediately from the second shutoff valve to the third branching point in at least a separate mode of operation, and wherein the fluid flows immediately from the third branching point to the intersection point in the separate mode of operation.

16. The heat pump of claim 13, wherein the fluid flows from the vapor generator to the second heat exchanger in a first mode of operation, and wherein the fluid flows from the second heat exchanger to the vapor generator in a second mode of operation.

* * * * *